US005184164A

United States Patent [19]

Kose et al.

[11] Patent Number: 5,184,164

[45] Date of Patent: Feb. 2, 1993

[54] PHOTOSENSITIVE MATERIAL PROCESSOR

[75] Inventors: Junichi Kose; Akira Sugiyama; Minoru Yamada; Ryoei Nozaki, all of Kanagawa, Japan

[73] Assignee: Fuji Photo Film Co., Ltd., Kanagawa, Japan

[21] Appl. No.: 707,553

[22] Filed: May 30, 1991

[30] Foreign Application Priority Data

Jun. 1, 1990 [JP] Japan ..... 2-143554
Jun. 1, 1990 [JP] Japan ..... 2-143560
Dec. 10, 1990 [JP] Japan ..... 2-400286[U]

[51] Int. Cl.[5] ..... G03D 13/00; G03D 3/02

[52] U.S. Cl. ..... 354/298; 354/324

[58] Field of Search ..... 354/319, 322, 299, 323, 354/324, 297, 298, 336

[56] References Cited

U.S. PATENT DOCUMENTS 4,103,358 7/1978 Gacki et al. ..... 354/323 X
4,165,186 8/1979 Tortorich et al. ..... 354/324 X
4,814,809 3/1989 De Prijcker et al. ..... 354/319

FOREIGN PATENT DOCUMENTS 2-52343 2/1990 Japan .

*Primary Examiner*—Richard A. Wintercorn

*Assistant Examiner*—D. Rutledge

*Attorney, Agent, or Firm*—Sughrue, Mion, Zinn, Macpeak & Seas

[57] ABSTRACT

A photosensitive material processor having a processing tank for processing a photosensitive material includes a circulating pipeline having a circulating pump for circulating a liquid in the processing tank; a first pump for supplying for supplying a stock solution to a mixing tank; a second pump for supplying a dilution liquid to the mixing tank; a supply pipeline for connecting the mixing tank and a portion of the circulating pipeline upstream of the circulating pump so that the processing solution prepared in the mixing tank is supplied to the processing tank; and a controller for controlling the first and second pumps so that a ratio of periods of discharge of the liquids becomes a predetermined ratio and for operating the circulating pump when the stock solution and the dilution liquid are supplied to the mixing tank by predetermined amounts. Accordingly, in a case where the processing solution is supplied to an empty processing tank, since the circulating pump is operated when the stock solution and the dilution liquid are supplied to the mixing tank by predetermined amounts, the processing solution is sucked by the circulating pump, and air is prevented from remaining in the supply pipeline and the like.

26 Claims, 17 Drawing Sheets

PHOTOSENSITIVE MATERIAL PROCESSOR

BACKGROUND OF THE INVENTION

1. Field of the Invention

The present invention relates to a photosensitive material processor, and more particularly to a processing solution supplying apparatus of a photosensitive material processor for supplying processing solutions such as working solutions and replenishing solutions to processing tanks of the photosensitive material processor such as an automatic processor.

2. Description of the Related Art

An automatic processor for automatically developing, fixing, washing and drying a photosensitive material is provided with a developing tank in which a developer is stored, a fixing tank in which a fixer is stored, and the like. Working solutions such as a developer and a fixer are supplied to the developing tank and the fixing tank when the automatic processor is initially used. In addition, since the developer undergoes a decline in its developing capability due to the processing of the photosensitive material and oxidation by oxygen in the air, and the fixer is consumed in the processing of the photosensitive material and by being discharged as attached to the photosensitive material processed, replenishing solutions are supplied to the developing tank and the fixing tank so as to recover the processing capabilities of the solutions and maintain the levels of the solutions to fixed levels.

To supply these working solutions and replenishing solutions, as disclosed in Japanese Patent Application Laid-Open Publication No. 52343/1990, it has been proposed to prepare the working solutions and replenishing solutions by mixing a stock solution and a dilution liquid in respective mixing tanks immediately before being supplied to the processing tanks and to supply them to the respective tanks. With this technique, in a case where the stock solution and the dilution liquid are supplied to the mixing tank at the time of initial use of the automatic processor or replacement of the solution, a stock solution supplying pump and a dilution liquid supplying pump are operated simultaneously, and the two pumps are respectively stopped after the lapse of an operating period set in advance for each tank at a predetermined ratio.

Meanwhile, the developing tank and the fixing tank are respectively provided with a circulating system comprising a circulating pipeline, a circulating pump, and a heat exchanger. The temperatures of the developer in the developing tank and the fixer in the fixing tank are controlled to fixed levels as the solutions are being circulated by these circulating systems. The aforementioned mixing tanks are respectively made to communicate with a portion of the circulating pipeline upstream of the circulating pump via a supply pipeline. Accordingly, when the automatic processor is initially used or the solution is replaced, the processing solution prepared in the mixing tank is supplied to the developing tank or the fixing tank by its own weight via the supply pipeline until a solution level in the developing tank or the fixing tank becomes identical with the solution level in a storage portion.

With the above-described technique, however, when the automatic processor is initially used or the solution is replaced, the processing solution is supplied to an empty processing tank, so that there are cases where air remains in the circulating system. For this reason, if the circulating pump is operated at the time of starting the processing of the photosensitive material, there are cases where the air is discharged at a stretch into the developer in the developing tank or the fixer in the fixing tank, thereby causing the developer or the fixer to scatter or enter another tank. In addition, after the air is quickly vented, the solution level declines, making it impossible to detect an accurate solution level. With respect to the mixing tank, meanwhile, there are cases where the residual air causes the processing solution not to be properly supplied to the supply pipeline or causes the processing solution to overflow from the mixing tank, or the solution is scattered when the air is vented from the mixing tank.

SUMMARY OF THE INVENTION

Accordingly, it is an object of the present invention to provide a photosensitive material processor in which air is prevented from remaining in a pipeline or the like when a processing solution is supplied to an empty processing tank, thereby overcoming the above-described drawbacks of the conventional art.

To this end, in accordance with one aspect of the invention, there is provided a photosensitive material processor having a processing tank for processing a photosensitive material, comprising: a circulating system having a circulating pipeline and a circulating pump disposed in the circulating pipeline and adapted to circulate a liquid in the processing tank through the circulating pipeline by the operation of the circulating pump; a mixing tank for preparing a processing solution by mixing a stock solution and a dilution liquid; a stock solution supplying pump for supplying the stock solution to the mixing tank; a dilution liquid supplying pump for supplying the dilution liquid to the mixing tank; a supply pipeline for connecting the mixing tank and a portion of the circulating pipeline upstream of the circulating pump so that the processing solution prepared in the mixing tank is supplied to the processing tank; and control means for controlling the stock solution supplying pump and the dilution liquid supplying pump so that a ratio of periods of discharge of the liquids becomes a predetermined ratio, and for operating the circulating pump after the stock solution and the dilution liquid are supplied to the mixing tank by predetermined amounts.

In accordance with this aspect of the invention, the mixing tank for preparing a processing solution by mixing a stock solution and a dilution liquid communicates with a portion of the circulating pipeline upstream of the circulating pump via the supply pipeline. The control means controls the stock solution supplying pump and the dilution liquid supplying pump so that a ratio of discharge of the liquids becomes a predetermined ratio. As a result, the stock solution and the dilution liquid are supplied to the mixing tank so as to prepare a processing solution. When the stock solution and the dilution liquid are supplied to the mixing tank, the control means operates the circulating pump. Whether or not the stock solution and the dilution liquid have been supplied by predetermined amounts may be detected by level sensors, or may be determined by the number of discharges or time durations of discharge. As a result, the processing solution in the mixing tank is supplied to an empty processing tank while being sucked by the circulating pump. The circulating pump is preferably run intermittently or continuously at a speed which does not cause idling. Thus, in order to supply the processing solution to the empty processing tank, the circulating pump is operated after the stock solution and the dilution liquid are supplied to the mixing tank by predetermined amounts. Hence, the processing solution is sucked by the circulating pump, and air is prevented from remaining in the supply pipeline and the like.

Thus in accordance with this aspect of the invention, in order to supply the processing solution to the empty processing tank, the circulating pump is operated after the stock solution and the dilution liquid are supplied to the mixing tank by predetermined amounts. Hence, it is possible to obtain an advantage in that air is prevented from remaining in the supply pipeline, thereby making it possible to prevent the scattering of the solution in processing tank and the overflowing of the solution accommodated in the mixing tank.

In accordance with another aspect of the invention, there is provided a photosensitive material processor for processing a photosensitive material by consecutively transporting the photosensitive material to a plurality of processing tanks in which processing solutions are accommodated therein, respectively, comprising: a solution supplying section in which a cartridge having a plurality of partitioned chambers with mutually different stock solutions accommodated therein is loaded; a plurality of stock tanks for respectively storing the stock solutions supplied from the solution supplying section so as to replenish the processing solutions in the processing tanks; level detecting means mounted in each tank, and adapted to detect the solution levels of the stock solutions in the stock tanks; indicating means for indicating replacement of the cartridge on the basis of a detection signal from the level detecting means; and control means for forcedly discharging remaining ones of the stock solutions when at least one of the solution levels detected by the level detecting means has reached a predetermined value or less, and for operating the indicating means when all the solution levels have reached predetermined values or less.

In addition, it is preferable to provide warning means for issuing a warning to replace the cartridge, so that the control means actuates the warning means when an amount of the photosensitive material processed since the actuation of the indicating means has reached a predetermined amount of processing.

In accordance with this aspect of the invention, the control means forcedly discharges remaining ones of the stock solutions when at least one of the solution levels detected by the level detecting means has reached a predetermined level or less, and the control means operates the indicating means when all the solution levels have reached predetermined values or less. In the partitioned chambers of the cartridge, when the solution level in a corresponding stock tank has declined below a predetermined level, no stock solution for replenishment remains in that partitioned chamber. Accordingly, when the indicating means has been operated, the stock solutions cease to exist in all of the partitioned chambers. Hence, the user is capable of readily ascertaining a replacement period of the cartridge in which the plurality of partitioned chambers are formed integrally.

In addition, when the indicating means has been operated, since stock solutions exist in none of the partitioned chambers, the processor and its surroundings are not stained during the replacement of the cartridge.

Furthermore, since the warning means is actuated when an amount of the photosensitive material processed since the actuation of the indicating means has reached a predetermined amount of processing, it is possible to positively inform the user of the replacement period of the cartridge by means of the indicating means and the warning means, and the user is capable of ascertaining the replacement period of the cartridge even more readily. Moreover, since the amount of processing set in advance is set as an amount of processing for determining whether or not further processing is possible, the user is capable of readily ascertaining a desirable replacement period.

Thus, in this aspect of the invention, since the remaining ones of the stock solutions are forcedly discharged when at least one of the solution levels detected by the level detecting means has reached a predetermined level or less, and the indicating means is operated when all the solution levels have reached predetermined values or less, it is possible to obtain an outstanding advantage in that the user is capable of readily ascertaining the replacement period of the cartridge.

In accordance with still another aspect of the invention, there is provided a photosensitive material processor having a processing tank for processing a photosensitive material, comprising: a mixing tank for preparing a processing solution by mixing a stock solution and a dilution liquid; a stock solution supplying pump for supplying the stock solution to the mixing tank; a dilution liquid supplying pump for supplying the dilution liquid to the mixing tank; a pipe for connecting the mixing tank and the processing tank so that the processing solution prepared in the mixing tank is supplied to the processing tank; and control means for controlling the stock solution supplying pump and the dilution liquid supplying pump with a predetermined ratio of periods of discharge of the liquids such that the periods of discharge of the liquids partially overlap with each other, and such that timings at which the discharge of the liquids is stopped become simultaneous or substantially simultaneous.

In accordance with this aspect of the invention, the stock solution supplying pump and the dilution liquid supplying pump supply the stock solution and the dilution liquid to the mixing tank, respectively. In the mixing tank, the stock solution and the dilution liquid are mixed to prepare a processing solution. The processing solution prepared in the mixing tank is supplied to the processing tank via the pipe. The control means controls the stock solution supplying pump and the dilution liquid supplying pump with a predetermined ratio of periods of discharge of the liquids such that the periods of discharge of the liquids partially overlap with each other, and such that timings at which the discharge of the liquids is stopped become simultaneous or substantially simultaneous. Thus, as the timings at which the discharge of the liquids by the stock solution supplying pump and the dilution liquid supplying pump is stopped are made to occur simultaneously or substantially simultaneously, the supply of the stock solution and the dilution liquid to the mixing tank is stopped simultaneously or substantially simultaneously. Hence, since the stock solution adhering to the inner wall surface of the mixing tank can be supplied to the processing tank while that stock solution is being washed away by the dilution liquid, it is possible to prevent a change in the composition of the processing solution.

The above and other objects, features and advantages of the invention will become more apparent from the following detailed description of the invention when read in conjunction with the accompanying drawings.

DESCRIPTION OF THE PREFERRED EMBODIMENTS

Referring now to the accompanying drawings, a detailed description will be given of an embodiment of the present invention. In this embodiment, the present invention is applied to a replenishing device of an automatic processor.

It should be noted that the supply of a processing solution to a processing tank of the automatic processor includes both a case where the processing solution is supplied to an empty processing tank at the time of initial use of the automatic processor or replacement of the solution and a case where a replenisher, i.e., a replenishing solution, is supplied to a processing tank as the processing of a photosensitive material proceeds. In this embodiment, a description will be given by citing the example of supplying replenishers to the processing tanks.

Figure 1:
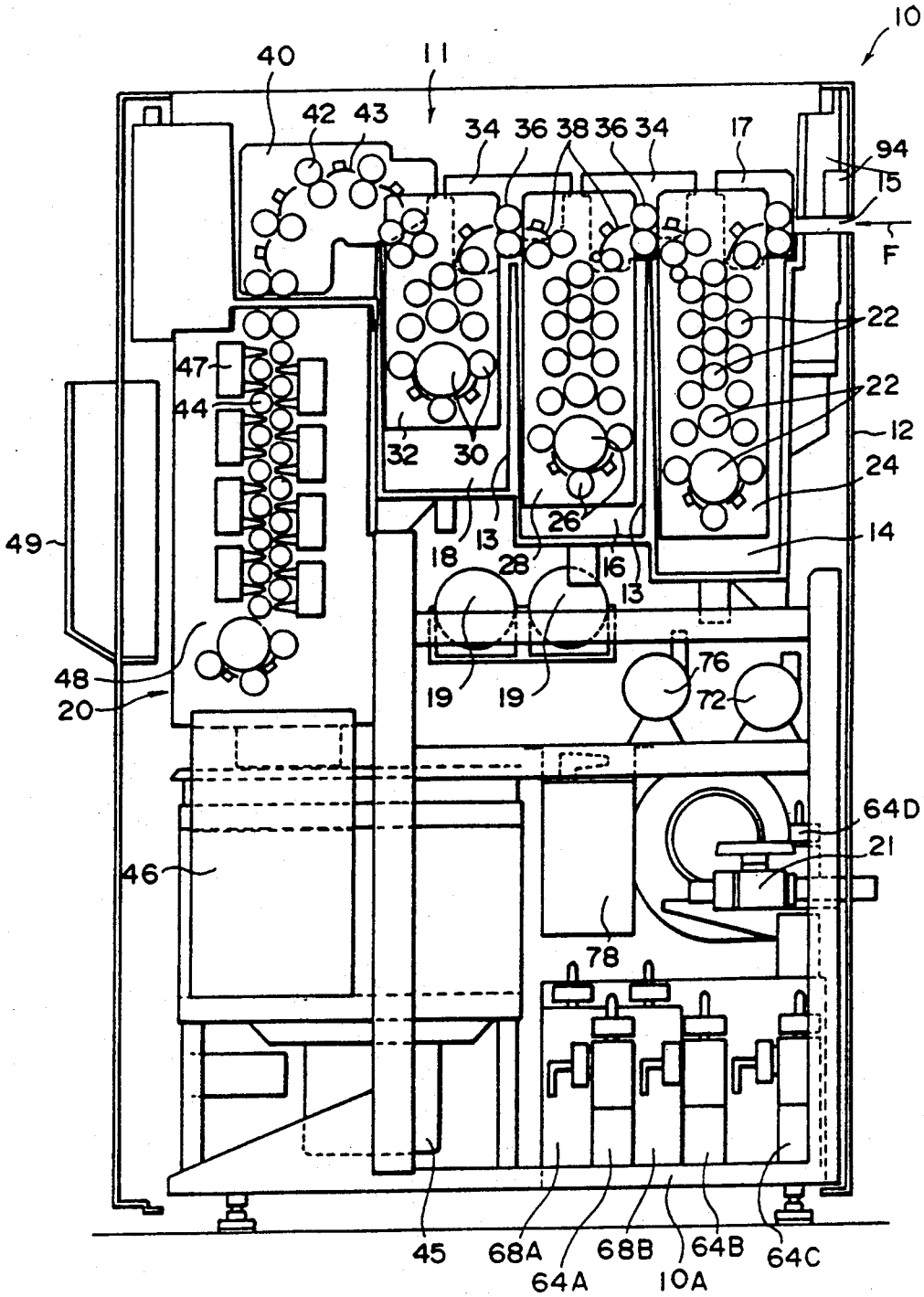
FIG. 1 is a cross-sectional view of essential portions of an automatic processor to which the present invention is applied.

As shown in FIG. 1, a processing section 11 and a drying section 20 are provided within a machine frame 12 of an automatic processor 10. The processing section 11 has a developing tank 14, a fixing tank 16, and a washing tank 18 that are arranged along the direction of travel of film F and are partitioned by partition walls 13.

An insertion rack 17 for drawing the film F into the automatic processor 10 is disposed in the vicinity of an insertion port 15 for the film F in the automatic processor 10.

In addition, an insertion detecting sensor 94 for detecting the film F being inserted is disposed in the vicinity of the insertion port 15. An insertion table for manually inserting the film F or an automatic feeder for automatically inserting the film F by a transporting means can be installed at the insertion port 15 of the automatic processor 10.

Inside the developing tank 14 in which a developer is stored, a transporting rack 24 having transport rollers 22 for transporting the film F by being driven by an unillustrated motor is disposed in such a manner as to be capable of being immersed in the developer. Inside the fixing tank 16 in which a fixer is stored, a transporting rack 28 having transport rollers 26 for transporting the film F by being driven by an unillustrated motor is disposed in such a manner as to be capable of being immersed in the fixer. In addition, inside the washing tank 18 in which washing water is stored, a transporting rack 32 having transport rollers 30 for transporting the film F by being driven by an unillustrated motor is disposed in such a manner as to be capable of being immersed in the washing water.

Heat exchangers 19 are disposed below the developing tank 14 and the fixing tank 16, respectively. The developer stored in the developing tank 14 and the fixer stored in the fixing tank 16 are respectively sent to the heat exchangers 19, and after being subjected to heat exchange there, the solutions are sent back to the developing tank 14 and the fixing tank 16. As a result, the temperatures of the developer stored in the developing tank 14 and the fixer stored in the fixing tank 16 are maintained within predetermined ranges.

Crossover racks 34 are disposed over the partition wall between the developing tank 14 and the fixing tank 16 and over the partition wall between the fixing tank 16 and the washing tank 18. These crossover racks 34 are each provided with a pair of transport rollers 36 for transporting the film F from the upstream tank to the downstream tank in the direction of travel of the film F as well as a guide 38 for guiding the film F.

The film F which has been inserted into the automatic processor 10 is inserted into the developing tank 14 from the insertion rack 17 and is transported through the developer by means of the transport rollers 22 so as to be subjected to development. The film F thus developed is transported to the fixing tank 16 via the crossover rack 34 and is transported through the fixer by means of the transport rollers 26 so as to be subjected to fixing. The film F thus fixed is transported to the washing tank 18 from the crossover rack 34 and is transported through the washing water by means of the transport rollers 30 so as to be subjected to washing. The film F is thus processed.

An end of an unillustrated solution-discharging pipe is fixed to the bottom of each of the developing tank 14, the fixing tank 16, and the washing tank 18, while the other end of the solution-discharging pipe is connected to each water-discharging valve 21. Accordingly, by opening these solution-discharging valves 21, it is possible to discharge the developer stored in the developing tank 14, the fixer stored in the fixing tank 16, and the washing water accommodated in the washing tank 18.

A squeeze rack 40 is disposed between the washing tank 18 and the drying section 20. This squeeze rack 40 has a plurality of guides 43 for guiding the film F and a plurality of pairs of transport rollers 42 for transporting to the drying section 20 the film F which has been transported from the washing tank 18 and onto which the washing water has been attached, while squeezing the washing water off the film F.

The drying section 20 comprises transport rollers 44 for transporting the film F, a drying fan 45 for supplying dry air, a chamber 46 incorporating a heater for heating the dry air, and a spray pipe 47 for spraying the heated dry air onto the film F and the transport rollers 44. In addition, a dry turning section 48 is disposed downstream of the transport rollers 44 on the transport passage of the film F, and the direction of travel of the film F is changed at this dry turning section 48 so as to transport the film F diagonally upward.

A film receiving box 49 for accommodating the film F transported from the dry turning section 48 is disposed on the automatic processor 10 in such a manner as to project from an outer wall of the automatic processor 10.

The film F with the washing water squeezed off at the squeeze rack 40 is dried by dry air blown from the spray pipe 47 while the film F is being transported by the transport rollers 44 heated by the dry air. Subsequently, the direction of travel of the film F is turned by the dry turning section 48 and the film F is then transported to the film receiving box 49 so as to be accommodated therein.

Figure 2:
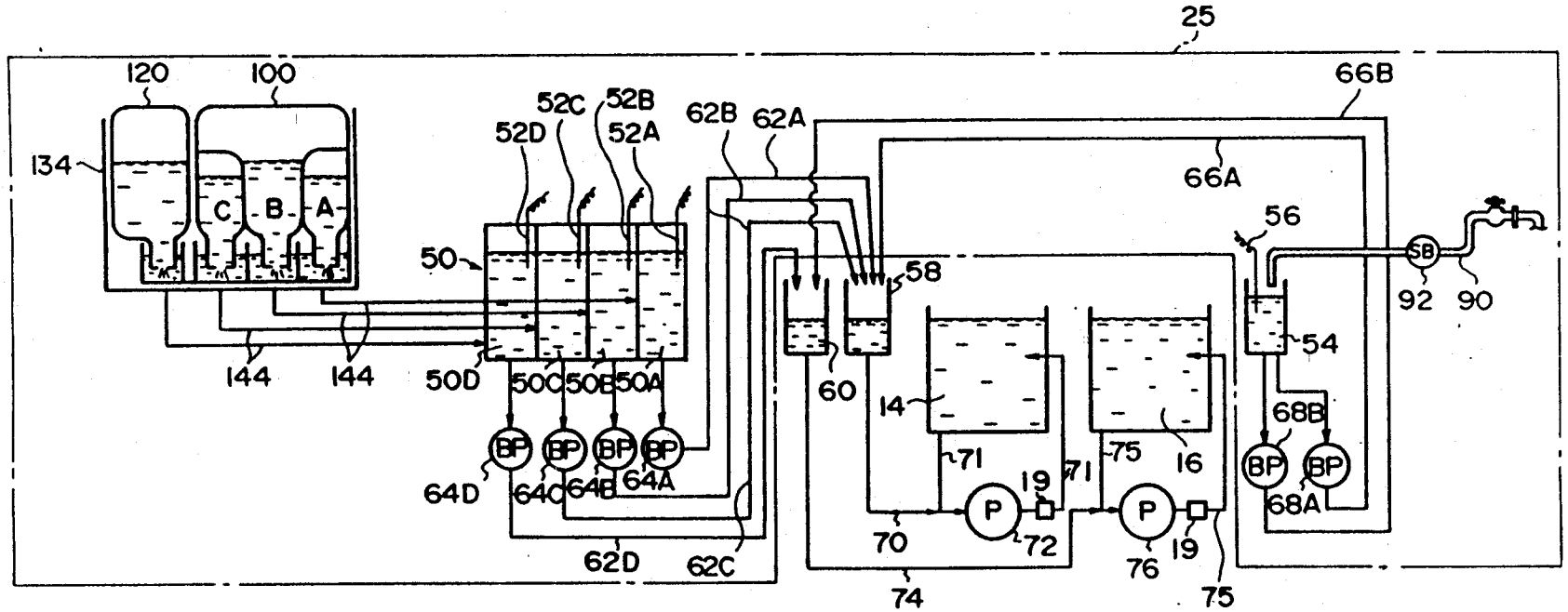
FIG. 2 is a systematic diagram of a replenishing device.

Referring now to FIG. 2, a description will be given of a replenishing device 25. The replenishing device 25 supplies a development replenisher to the developing tank 14 and supplies a fixing replenisher to the fixing tank 16. It should be noted that in this embodiment the development replenisher supplied to the developing tank 14 is prepared by mixing three kinds of undiluted development replenishers A, B, and C and water used as a dilution liquid, while the fixing replenisher supplied to the fixing tank 16 is prepared by mixing one kind of an undiluted fixing replenisher and water.

Figure 3:
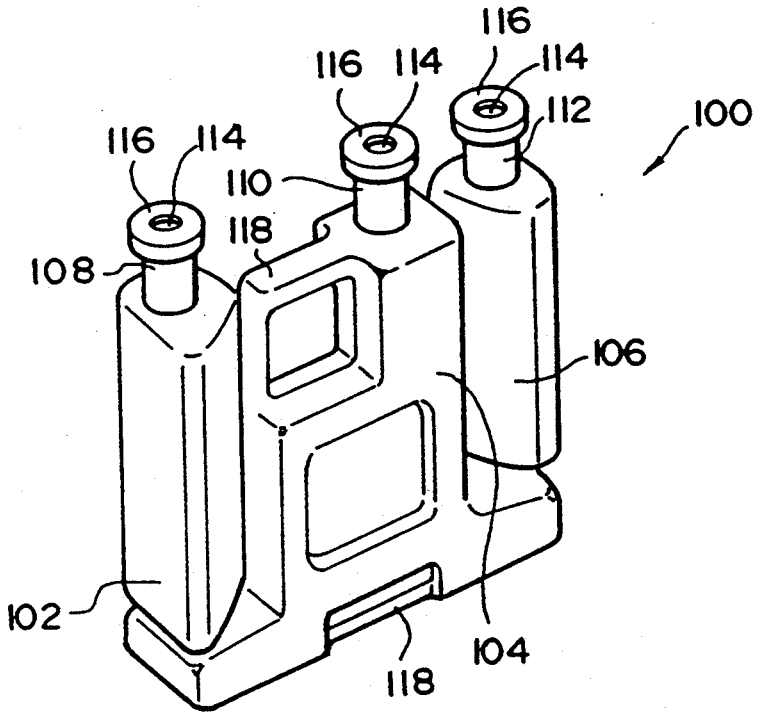
FIG. 3 is a perspective view of a cartridge for accommodating undiluted development replenishers.

As shown in FIG. 3, the undiluted development replenishers are filled and hermetically sealed in advance in a cartridge 100 which is an undiluted replenisher tank. The interior of this cartridge 100 is partitioned into three chambers by means of partition walls. A solution A is filled in a first chamber 102, a solution B is filled in a second chamber 104, and a solution C is filled in a third chamber 106. The compositions of the solutions A, B and C are, for instance, as follows:

| | |
|---|---|
| Solution A: | |
| Potassum hydroxide | 330 g |
| Potassium sulfite | 630 g |
| Sodium sulfite | 240 g |
| Potassium carbonate | 90 g |
| Boric acid | 45 g |
| Diethylene glycol | 180 g |
| Diethylenetriaminepentaacetic acid | 30 g |
| 3,3'-dithiobis hyrocinnamic acid | 3 g |
| 5-methyl-benzotriazole | 0.025 g |
| Hydroquinone | 450 g |
| Potassium bromide | 15 g |
| Total volume with water added: | 4125 ml |
| Solution B: | |
| Triethylene glycol | 525 g |
| Glacial acetic acid | 102.6 g |
| 5-nitroindazole | 3.75 g |
| 1-phenyl-3-pyrazolidone | 34.5 g |
| Total volume with water added: | 750 ml |
| Solution C: | |

-continued

| | |
|---|---|
| Glutaraldehyde (50 wt/wt %) | 150 g or 0 g |
| Patassium metabisulfite | 150 g |
| Total volume with water added: | 750 ml |

Filling ports 108, 110, and 112 are provided in those portions of the cartridge 100 that correspond to the first chamber 102, the second chamber 104, and the third chamber 106, respectively. These filling ports are cylindrically shaped and extend up to the same height in the same direction, respectively. Packing 114 is provided on the open end of each of the filling ports 108, 110, and 112, and this packing 114 closes each opening of the filling port 108, 110, and 112 by being pressed by each cap 116 threadedly secured to each of the filling ports 108, 110, and 112.

It should be noted that handles 118 for being gripped by the user at the time of the handling of the cartridge 100 are provided on both the side of the cartridge 100 where the filling ports 108, 110, and 112 are disposed and the opposite side thereof.

Figure 4:
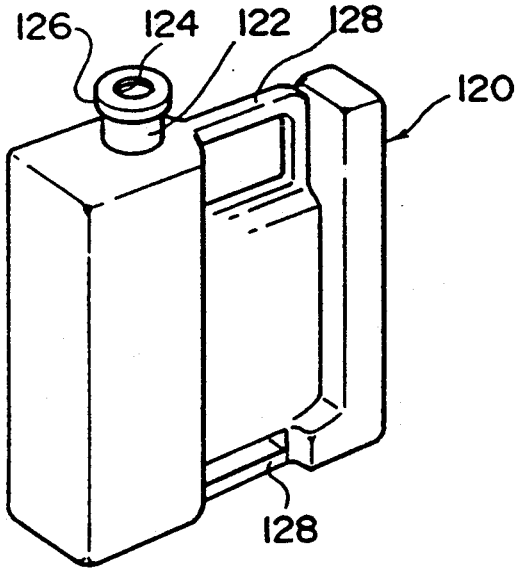
FIG. 4 is a perspective view of a cartridge for accommodating an undiluted fixing replenisher.

As shown in FIG. 4, the undiluted fixing replenisher is similarly filled and hermetically sealed in advance in a cartridge 120 which is an undiluted replenisher tank. A cylindrical filling port 122 is provided in the cartridge 120. Packing 124 is provided at the open end of this filling port 122, and the packing 124 closes the opening of the filling port 122 by being pressed a cap 126 threadedly secured to the filling port 122.

In this cartridge 120 as well, handles 128 for being gripped by the user at the time of the handling of the cartridge 120 are provided on both the side of the filling port 122 and the opposite side thereof.

The replenishing device 25 accommodates the cartridges 100 and 120 with their filling ports 108, 110, 112 and 122 facing downwards and a solution supplying section 130 for supplying the undiluted development replenishers and the undiluted fixing replenisher in the cartridges 100 and 120 to a stock tank 50 which will be described later. Referring to FIGS. 5 to 8, a description will be given hereinafter of this solution supplying section 130. The solution supplying section 130 is disposed on the machine frame 12 side in parallel with the direction of travel of the film F. It should be noted that the side where the solution supplying section 130 is disposed is this side as viewed in FIG. 1. The solution supplying section 130 comprises an outer panel 132 constituting a part of outer side walls of the automatic processor 10 as well as a cartridge receiver 134 secured to an inner side surface of this outer panel 132. This cartridge receiver 134 is formed into the configuration of a box whose upper side is open, and is formed into a size capable of accommodating the cartridges 100 and 120.

Figure 6:
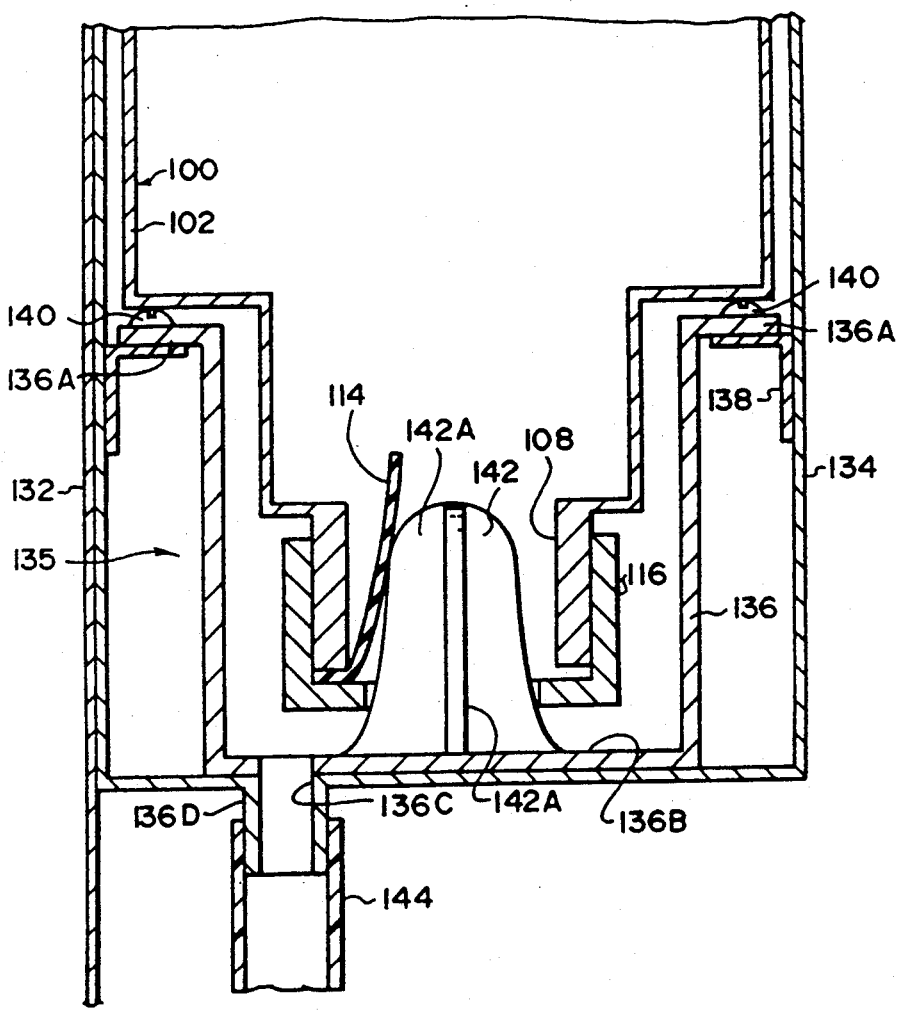
FIG. 6 is a cross-sectional view of a perforating section.

Perforating portions 135 are respectively formed in the bottom of the cartridge receiver 134 in correspondence with the filling ports 108, 110, and 112 of the cartridges 100 and 120 that are accommodated (see FIG. 6). Since these perforating portions have substantially the same configuration, a description will be given here of the perforating portion 135 corresponding to the first chamber 102 of the cartridge 100 in which the solution A is filled.

Figure 6A:
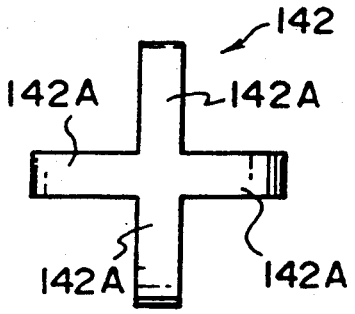
FIG. 6A is a cross-sectional view of a projection.

As shown in FIG. 6, a solution pan 136 having the shape of an inverted hat is disposed in the perforating portion 135. The solution pan 136 is secured by means of screws 140 via a flange 136A thereof to mounting brackets 138 affixed to side walls of the cartridge receiver 134. A projection 142 is provided in the center of the bottom 136B of the solution pan 136. This projection 142 is formed by combining four tabular members 142A substantially into a cross, as shown in FIG. 6A. Each tabular member 142A is formed in such a manner that the width thereof expands gradually from its tip portion toward its bottom end, and its upper end face is formed into an arcuate configuration in such a manner as to continue smoothly with its side end face. It should be noted that the projection 142 may be formed into the above-described configuration by processing a single member, or the projection 142 may be secured to the bottom 136B or may be placed on the bottom 136B.

A coupling pipe 136D whose inner peripheral portion is formed as a passage 136C and which penetrates a bottom wall of the cartridge receiver 134 and extends downward is disposed in the vicinity of the projection 142 at the bottom 136B of the solution pan 136. This coupling pipe 136D is fitted with one end of a flexible pipe 144. The other end of this flexible pipe 144 communicates with the bottom of the stock tank 50 which will be described later. As for the cartridge 100 inserted into the cartridge receiver 134, the packing 114 of the filling port 108 corresponding to the first chamber 102 thereof is pushed into the cartridge 100 by means of the projection 142. As a result, the solution A flows to the solution pan 136 and then to the stock tank 50 through the passage 136C of the coupling pipe 136D and the pipe 144. It should be noted that although in this embodiment the arranged provided is such that the packing 114 is pushed into the filling port 108 by the projection 142, an arrangement may be alternatively adopted in which the packing 114 is penetrated by a boring blade.

The solution A flows to the solution pan 136 through the gap between the projection 142 and the cap 116, and the height of the cartridge receiver 134 is set to be substantially the same as that of the stock tank 50 so that the solution A which has flown out remains at a predetermined solution level inside the solution pan 136.

Since the perforating portions 135 are provided in correspondence with the filling ports 108, 110, 112, and 122 of the cartridges 100 and 120, respectively, as described above, the solutions A, B, and C and the undiluted fixing replenisher i.e., stock solutions or concentrated solutions in the cartridges 100 and 120 inserted into the cartridge receiver 134 are respectively supplied to the stock tank 50.

The levels of each solution in the cartridge 100 or 120, in the solution pan 136 and in the stock tank 50 hold the balance as shown in FIG. 2, because the air pressure at the upper space on the solution in each chamber of the cartridge is reduced due to flowing out of the solution therefrom.

Although in the above-described example the perforating portions 135 are provided separately in correspondence with the filling ports 108, 110, 112, and 122, respectively, these perforating portions 135 may be connected to each other, as necessary.

Figure 5:
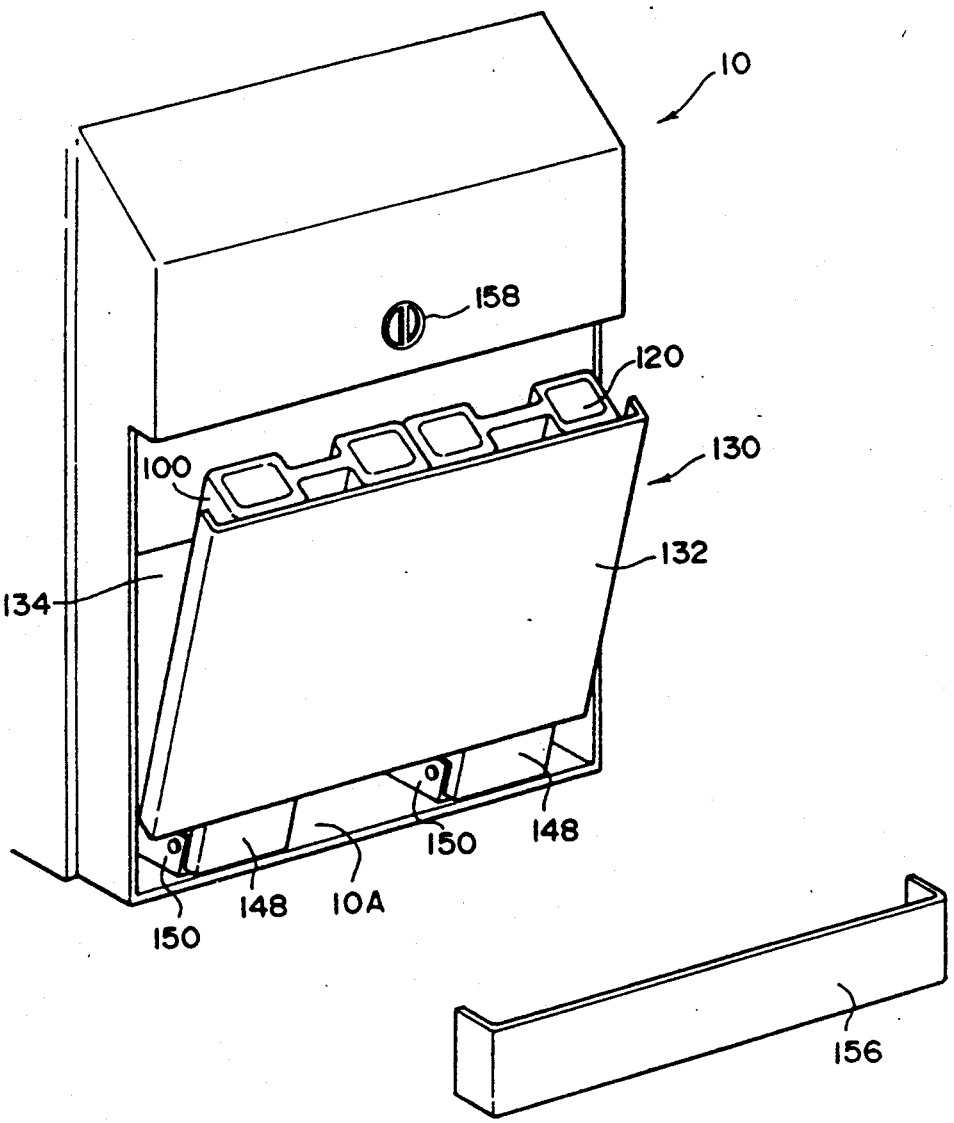
FIG. 5 is a perspective view of a solution supplying section.
Figure 8:
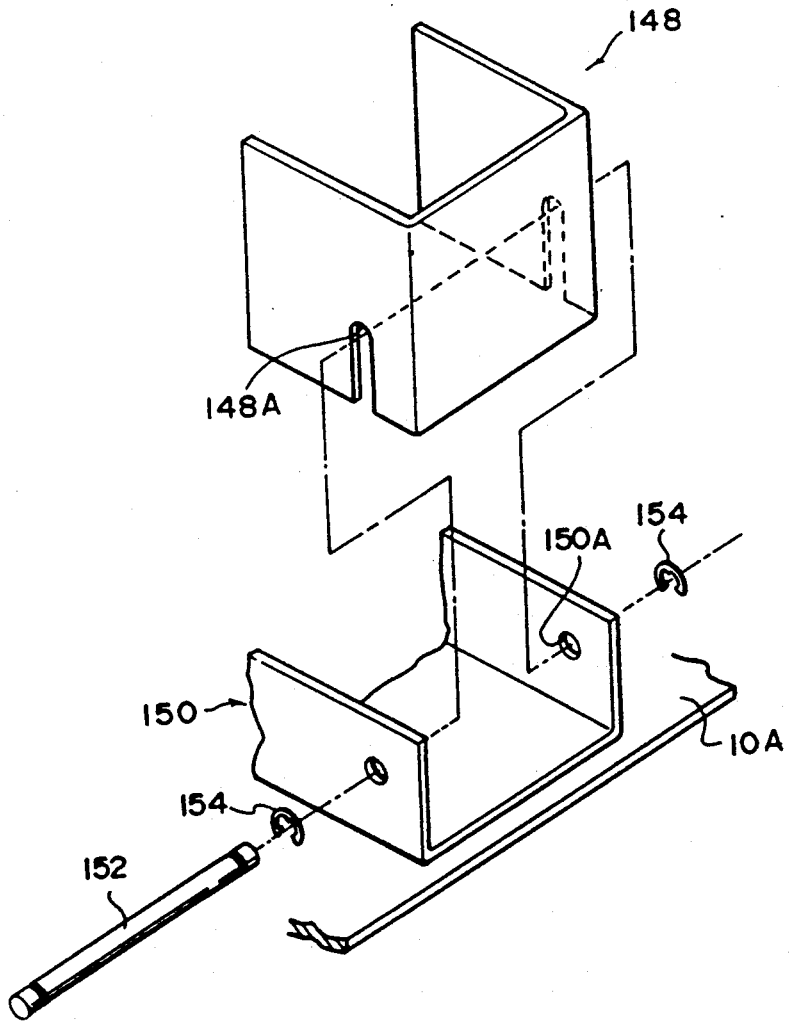
FIG. 8 is an exploded perspective view of a swinging portion of the solution supplying section.

The solution supplying section 130 arranged as described above is supported swingably about the lower end of the outer panel 132. That is, as shown in FIG. 5, a pair of leg portions 148 project downward from the lower end of the outer panel 132. As shown in FIG. 8, these leg portions 148 are each formed of a tabular material bent into a substantially U-shaped cross section, and a U-shaped slit 148A extending upward from its lower end is formed at each of the opposing walls thereof.

Meanwhile, a pair of receivers 150 secured to a bottom plate 10A of the automatic processor 10 and adapted to receive a lower portion of the leg portion 148 are mounted in a side portion of the main body of the automatic processor 10, As shown in FIG. 8, each of the receivers 150 has a substantially U-shaped cross section which is upwardly open, and through-holes 150A are formed in opposing walls thereof at mutually opposing positions. After a shaft member 152 is inserted into the through-holes 150A, a pair of E-rings 154 are respectively fitted at projecting portions of the shaft member 152 projecting from the respective through-holes 150A, so as to fit the shaft member 152. Then, the leg portion 148 is fitted in such a manner that the shaft member 152 enters the U-shaped slits 148A of the leg portion 148, thereby rendering the solution supplying section 130 swingable. It should be noted that the solution supplying section 130 may be arranged such that an elongated bolt is inserted into the through holes 150A, a nut is made to threadedly engage with the tip of the elongated bolt, and the elongated bolt enters the U-shaped slits 148A of the leg portion 148.

Figure 7:
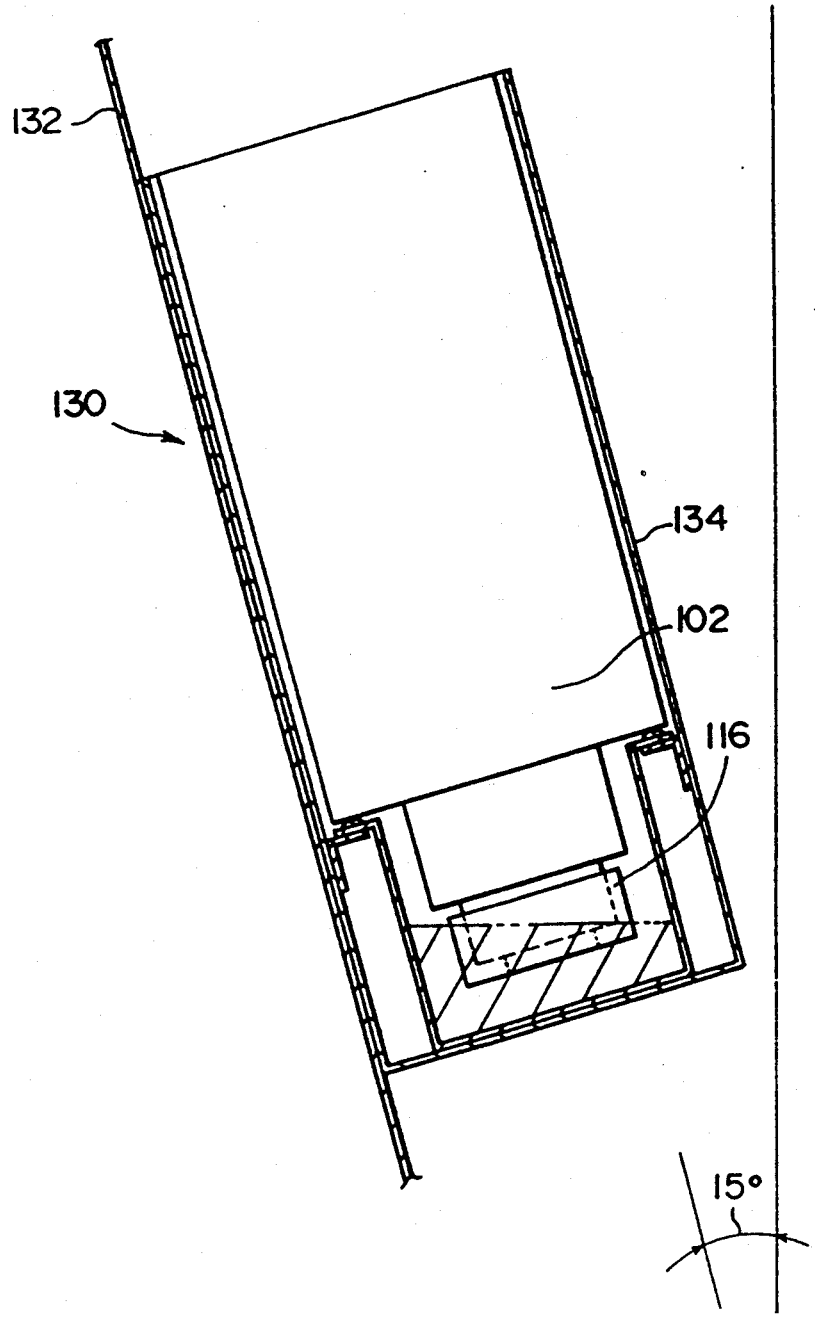
FIG. 7 is a cross-sectional view illustrating a state in which the cartridge receiver is inclined.

Provided above the solution supplying section 130 of the automatic processor 10 is a retaining member 158 (FIG. 5) for maintaining the solution supplying section 130 in a closed state by engaging with an unillustrated retaining projection provided on the inner side of the outer panel 132 of the solution supplying section 130 in a state in which the solution supplying section 130 is in the closed state. This retaining member 158 is disengaged from the retaining projection as the retaining member 158 is rotated by a predetermined angle. In addition, the interior of the cartridge receiver 134 of the solution supplying section 130 and the interior of the automatic processor 10 are connected to each other by means of an unillustrated gas damper. This gas damper ensures that the solution supplying section 130 can be swung smoothly from the closed state of the solution supplying section 130, i.e., the state in which the cartridges 100 and 120, are accommodated, to the open state thereof, i.e., the state in which the cartridges 100 and 120 can be inserted or removed. At the same time, the gas damper restricts the swinging motion of the solution supplying section to a predetermined angle. It should be noted that in this embodiment when the solution supplying section 130 is swung by 15° from the closed state, as shown in FIG. 7, the swinging motion is stopped by the gas damper. The restriction of the swinging motion is set by taking into consideration the bubbling up of the solutions remaining in the solution pans 136 at the time of the opening and closing of the solution supplying section 130, and the present invention is not restricted to this swinging angle.

In addition, provided below the solution supplying section 130 of the automatic processor 10 is a cover 156 for covering the leg portions 148 and the receivers 150 so as to improve the outer appearance of the automatic processor 10.

Furthermore, an two-split type unillustrated removable cover is provided on the side of the automatic processor 10 which is away from the side where the solution supplying section 130 is disposed, so as to cover portions corresponding to the solution supplying section 130 and a portion covered by the cover 156. On the inner side of this cover, the same type of receivers (not shown) as the receivers 150 are disposed on the bottom plate 10A of the automatic processor 10. Accordingly, the solution supplying section 130 can be reinstalled to the later-mentioned side from the first-mentioned side of the automatic processor 10 by removing the shaft members 152, the E-rings 154, and the unillustrated gas damper.

The stock tank 50 is disposed on the bottom plate 10A of the automatic processor 10. As shown in FIG. 2, the stock tank 50 is partitioned into four tanks by means of partition walls. A first tank 50A, a second tank 50B, a third tank 50C, and a fourth tank 50D inside the stock tank 50 respectively communicate with the first chamber 102, the second chamber 104, the third chamber 106 of the cartridge 100 and with the cartridge 120 via the pipes 144. Accordingly, the first tank 50A stores the solution A filled in the first chamber 102; the second tank 50B stores the solution B filled in the second chamber 104; the third tank 50C stores the solution C filled in the third chamber 106; and the fourth tank 50D stores the undiluted fixing replenisher filled in the cartridge 120.

Meanwhile, in the automatic processor 10, a water supply tank 54 to which running water is supplied and which stores the same is disposed on the side of the squeeze rack 40, shown in FIG. 1, which is away from this side as viewed in the drawing (see FIG. 2).

Also disposed in the automatic processor 10 are a first mixing tank 58 for preparing the development replenisher to be supplied to the developing tank 14 as well as a second mixing tank 60 for preparing the fixing replenisher to be supplied to the fixing tank 16.

As shown in FIG. 2, one ends of pipelines 62A, 62B, and 62C communicate with the first tank 50A, the second tank 50B, and the third tank 50C, respectively, while the other ends of the pipelines 62A, 62B, and 62C respectively communicate with the first mixing tank 58. A solution A pump 64A, a solution B pump 64B, and a solution C pump 64C, which are constituted by bellows pumps, are disposed in the pipelines 62A, 62B, and 62C, respectively. In addition, one end of a pipeline 66A communicates with the water supply tank 54, while the other end of the pipeline 66A communicates with the first mixing tank 58. A water pump 68A constituted by a bellows pump is disposed in the pipeline 66A. Accordingly, when the solution A pump 64A, the solution B pump 64B, the solution C pump 64C, and the water pump 68A are operated, the solution A in the first tank 50A, the solution B in the second tank 50B, the solution C in the third tank 50C, and the running water in the water supply tank 54 are supplied to the first mixing tank 58 via the respective pipelines 62A, 62B, 62C, and 66A. In the mixing tank 58, the solutions A, B, and C are mixed and are diluted by the running water so as to prepare the development replenisher to be supplied to the developing tank 14.

In addition, one end of a pipeline 62D communicates with the fourth tank 50D, while the other end of this pipeline 62D communicates with the second mixing tank 60. A solution D pump (bellows pump) 64D is disposed in the pipeline 62D. One end of a pipeline 66B communicates with the water supply tank 54, while the other end of the pipeline 66B communicates with the second mixing tank 60. A bellows pump 68B is disposed in the pipeline 66B. Accordingly, when the bellows pumps 64D and 68B are operated, the undiluted fixing replenisher in the fourth tank 50D and the running water in the water supply tank 54 are supplied to the second mixing tank 60. In the mixing tank 60, the undiluted fixing replenisher is diluted by the running water so as to prepare the fixing replenisher to be supplied to the fixing tank 16.

Opposite ends of a pipeline 71 for circulating the developer communicate with the developing tank 14, and a circulating pump 72 and the heat exchanger 19 for controlling the temperature of the developer to a fixed level are provided in the pipeline 71. Incidentally, a heater may be used instead of the heat exchanger 19.

One end of a pipeline 70 communicates with the bottom of the first mixing tank 58, while the other end thereof communicates with a portion of the pipeline 71 upstream of the circulating pump 72. Accordingly, the development replenisher prepared in the first mixing tank 58 is supplied gradually to the development tank 14 by the operation of the circulating pump 72 via the pipelines 70 and 71. When the circulating pump 72 is operated, the development replenisher is supplied to the developing tank 14 while being mixed with the developer which is being sucked and is circulating in the pipeline 71 by means of the circulating pump 72.

Opposite ends of a pipeline 75 for circulating the fixer communicate with the fixing tank 16, and a circulating pump 76 is provided in the pipeline 75. One end of a pipeline 74 communicates with the second mixing tank 60, while the other end thereof communicates with a portion of the pipeline 75 upstream of the circulating pump 76. Accordingly, when the circulating pump 76 is operated in the same way as the case of the development replenisher, the fixing replenisher prepared in the second mixing tank 60 is supplied to the fixing tank 16 while being mixed with the fixer being circulated through the pipeline 75 via the pipeline 74.

It should be noted that the water supply tank 54 and the washing tank 18 communicate with each other through an unillustrated pipeline, and the water supply tank 54 and the washing tank 18 are disposed in such a manner that their internal water levels become identical. The replenishment of the washing tank 18 with water is effected by opening a solenoid valve 92 disposed midway in a pipeline 90 disposed from a faucet for running water to the water supply tank 54 when the film F is detected by the insertion detecting sensor 94 disposed in the vicinity of the film insertion port 15 of the automatic processor 10.

As shown in FIG. 1, the automatic processor 10 has a cleaning pump 78 for cleaning the crossover racks 34. This cleaning pump 78 causes the running water in the water supply tank 54 to be sprayed over the crossover racks 34 through an unillustrated spray pipe disposed at an upper end surface of the partition wall 13, so as to clean the crossover racks 34. It should be noted that an antibacterial agent for preventing the development of water plants is mixed in the cleaning water for the crossover racks 34. As a result, it is possible to prevent the clogging of the cleaning-water discharging port of the unillustrated spray pipe due to the waterplants. The cleaning of the crossover racks 34 is effected upon completion of, for instance, a day's operation of the automatic processor 10.

Figure 9:
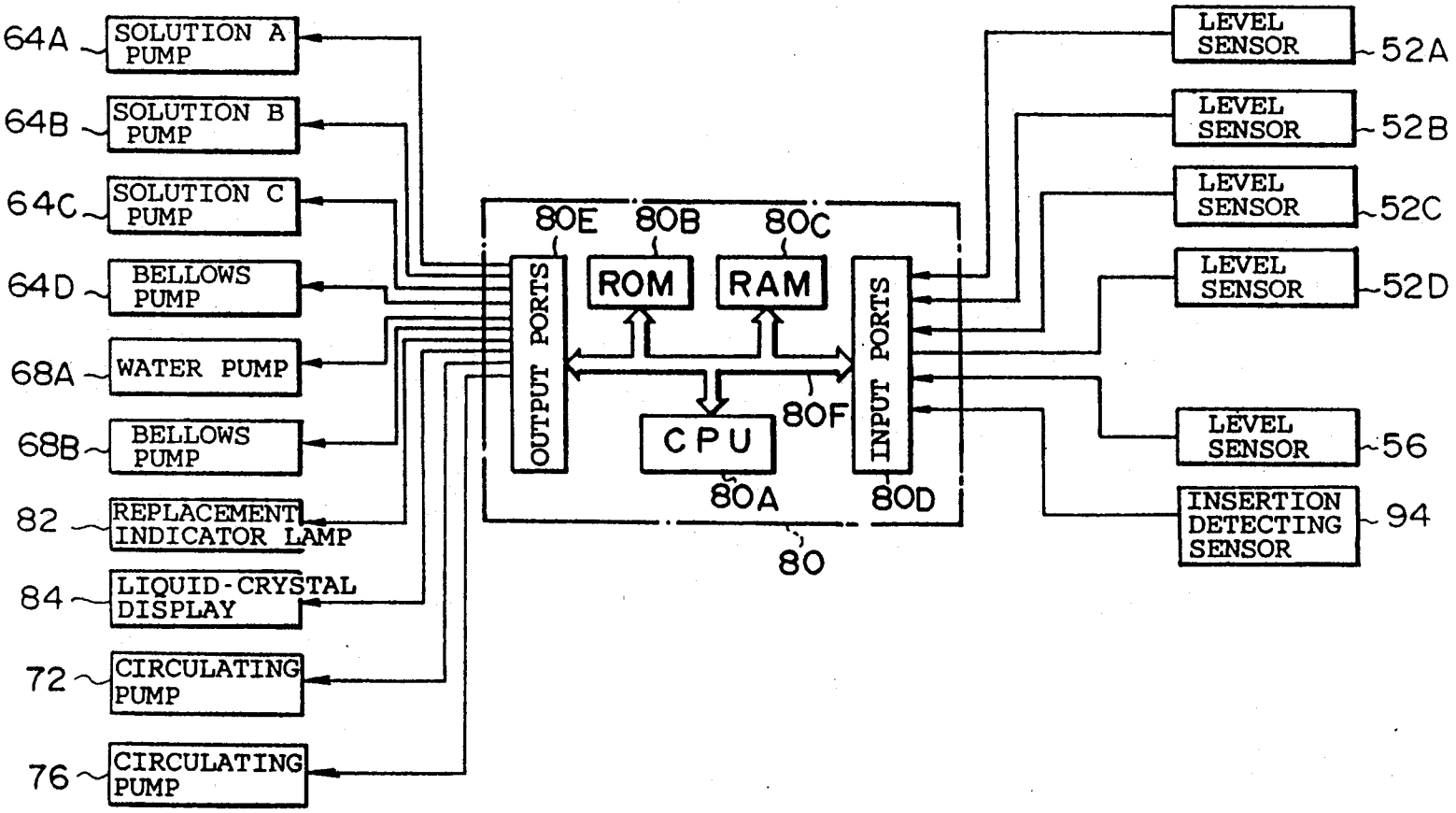
FIG. 9 is a schematic block diagram of the replenishing device.

In addition, as shown in FIG. 2, level sensors 52A, 52B, 52C, and 52D are disposed in upper portions of side walls of the tanks 50A, 50B, 50C, and 50D of the stock tank 50, respectively. These level sensors 52A–52D are respectively connected to input ports 80D of a controller 80, as shown in FIG. 9, and are adapted to detect the liquid levels in respective tanks and output the detected results to the controller 80. The controller 80 is configured such that a CPU 80A, a ROM 80B, a RAM 80C, the input ports 80D, and output ports 80E are connected to each other by means of a bus 80F such as a data bus. When the liquid level detected by any of the level sensors 52A–52D has reached a predetermined value or less, the controller 80 determines that the undiluted development replenisher in the cartridge 100 or the undiluted fixing replenisher in the cartridge 120 has been consumed and has become empty. Upon determining that it has become empty, the controller requests replacement of the cartridge. The pumps 64A, 64B, 64C, and 64D disposed in the pipelines 62 to 62D communicating with the tanks 50A to 50D, respectively, are connected to the output ports 80E of the controller, and their operation is controlled by the controller 80.

A level sensor 56 is similarly disposed in the water supply tank 54. This level sensor 56 is also connected to one of the input ports 80D of the controller 80, as shown in FIG. 9, and is adapted to detect the water level in the water supply tank 54 and output the detected result to the controller 80. When the water level detected by the level sensor 56 has reached a predetermined value or less, the controller 80 determines that the time for supplying running water has arrived and opens the solenoid valve 92. In addition, the water pumps (bellows pumps) 68A and 68B disposed in the pipelines 66A and 66B whose one ends communicate with the water supply tank 54 are respectively connected to the output ports 80E of the controller 80, so that these pumps 68A and 68B are controlled by the controller 80 in such a manner as to supply a predetermined amount of running water to the mixing tanks 58 and 60.

In addition, as shown in FIG. 9, the aforementioned insertion detecting sensor 94 is connected to one of the input ports 80D of the controller 80. On the basis of the detected result of the insertion detecting sensor 94, the controller calculates an amount of film F processed (processed area), and supplies development and fixing replenishers by operating the pumps 64A, 64B, 64C, 64D, 68A, and 68B.

A replacement indicator lamp 82 having a green lamp and a red lamp and a liquid-crystal display 84 are connected to the output ports 80E of the controller 80. As the types of display of the replacement indicator lamp 82, there are three types, the lighting of the green lamp, the lighting of the red lamp, and the flickering of the red lamp. The controller 80 effects control as follows: When the supply of the replenishers is being effected properly, the controller 80 lights the green lamp; when indicating the replacement of the cartridge 100 or 120 to the user, the controller 80 lights the red lamp; and when alarming the replacement of the cartridge 100 or 120 to the user, the controller 80 causes the red lamp to flicker. Additionally, controller 80 displays a message to the user on the liquid-crystal display 84. Furthermore, the circulating pumps 72 and 76 are connected to the controller 80.

A description will now be given of the operation of this embodiment. The film F with an image printed thereon is inserted into the automatic processor 10 through the insertion port 15, is subjected to processing by the developer, fixer, and washing water in the developing tank 14, the fixing tank 16, and the washing tank 18, and is transported to the squeeze rack to be squeezed. The film F thus squeezed is dried by the dry air and the transport rollers 44 heated in the drying section 20, and is accommodated in the film receiving box 49 via the dry turning section 48.

When the replenishers to be supplied to the developing tank 14 and the fixing tank 16 are prepared at the time of initially using the automatic processor 10, or when a processing solution is replaced midway in the course of processing, after the predetermined amounts of stock solutions and water are supplied to the mixing tanks 58 and 60, the circulating pumps are operated. Hence, air is prevented from remaining in the pipes of the circulating systems, and it is hence possible to prevent air from being discharged into the developer in the developing tank 14 and into the fixer in the fixing tank 16, which can otherwise cause the developer and fixer to be scattered or mixed into another tank. In addition, it is possible to prevent a situation in which the liquid levels decline due to the venting of air, making it impossible for the liquid levels to be detected accurately. Moreover, it is possible to prevent a situation in which the air remaining in the mixing tanks 58 and 60 causes faulty flow of the replenishers into the pipelines 70 and 71 or overflow from the mixing tanks 58 and 60, and a situation where the solution is scattered when the air is vented from the mixing tanks 58 and 60.

The developer in the developing tank 14 gradually undergoes deterioration as processing proceeds. For this reason, a predetermined amount of development replenisher is supplied from the mixing tank 58 to the developing tank 14 periodically or in correspondence with a predetermined amount of film processed. This replenishment is effected while the development replenisher in the mixing tank 58 is being mixed with the developer in the developing tank 14 by the intermittent operation of the circulating pump 72. Accordingly, during replenishment with the development replenisher, no unevenness occurs in the distribution of the components of the developer in the developing tank 14, and the distribution of the components becomes uniform.

Also, the fixer in the fixing tank 16 gradually undergoes deterioration as processing proceeds. For this reason, a predetermined amount of fixing replenisher is supplied from the mixing tank 60 to the fixing tank 16 periodically or in correspondence with a predetermined amount of film processed. This replenishment is effected while the fixing replenisher in the mixing tank 60 is being mixed with the fixer in the fixing tank 16 by the intermittent operation of the circulating pump 76. Accordingly, during replenishment of the fixing replenisher, no unevenness occurs in the distribution of the components of the fixer in the fixing tank 16.

When the cartridges 100 and 120 are inserted in the cartridge receivers in the solution supplying section 130, and the filling ports 108, 110, 112, and 122 are set in the perforating portions 135, respectively, the undiluted replenishers are supplied to the respective tanks of the stock tank 50. The liquid levels in the respective tanks are detected by the level sensors, and are detected results are outputted to the controller 80. At this juncture, the controller lights the green lamp of the replacement indicator lamp 82 and causes the liquid-crystal display 84 to display a message reading "FILM PROCESSING POSSIBLE".

Since the method of supplying the development replenisher and the method of supplying the fixing replenisher are identical, a description will be given below by citing the method of supplying the development replenisher.

Figure 10:
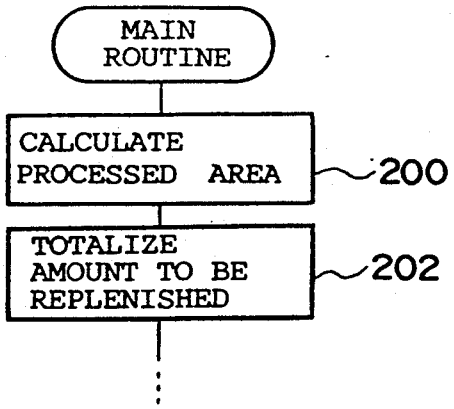
FIG. 10 is a flowchart illustrating a part of a main routine for replenishment with the replenisher.

FIG. 10 shows a part of a main routine for replenishment with the development replenisher. In Step 200, the processed area of the film F is calculated on the basis of the width of the film F being processed and an output of the insertion detecting sensor 94. In Step 202, an amount of development replenisher to be supplied in correspondence with this processed area is calculated, and the calculated value is added to the amount of replenishment which was determined previously, so as to calculate the value of a totalized amount of replenishment.

Then, the replenisher is supplied by an unillustrated interruption routine which is executed by interrupting at a replenishment timing (e.g., a timing when the processed area has reached a predetermined value or more).

Figure 11:
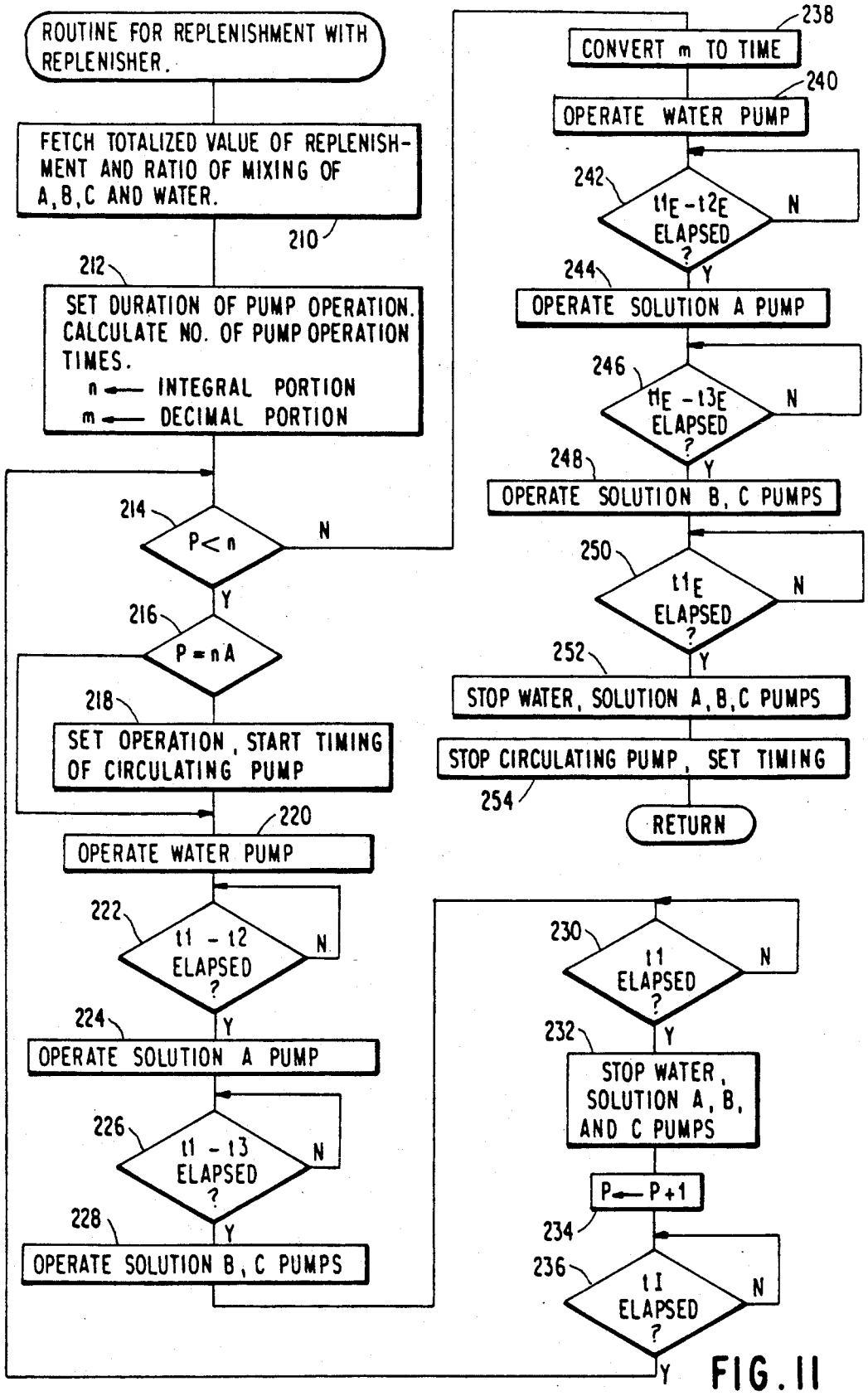
FIG. 11 is a flowchart illustrating a part of a routine for replenishment with the replenisher.

FIG. 11 shows a routine which is started when the automatic processor 1 is initially used or when the solution is to be replaced. In Step 210, a ratio at which the solutions A, B, and C and water are mixed for preparing the development replenisher to be supplied to the developing tank 14 is fetched. This mixing ratio can be determined as follows.

Solution A : solution B : solution C : water = 11 : 2 : 2 : 25 (e.g., solution A = 55 ml, solution B = solution C = 10 ml, water = 125 ml; pH = 10.5)

Figure 14:
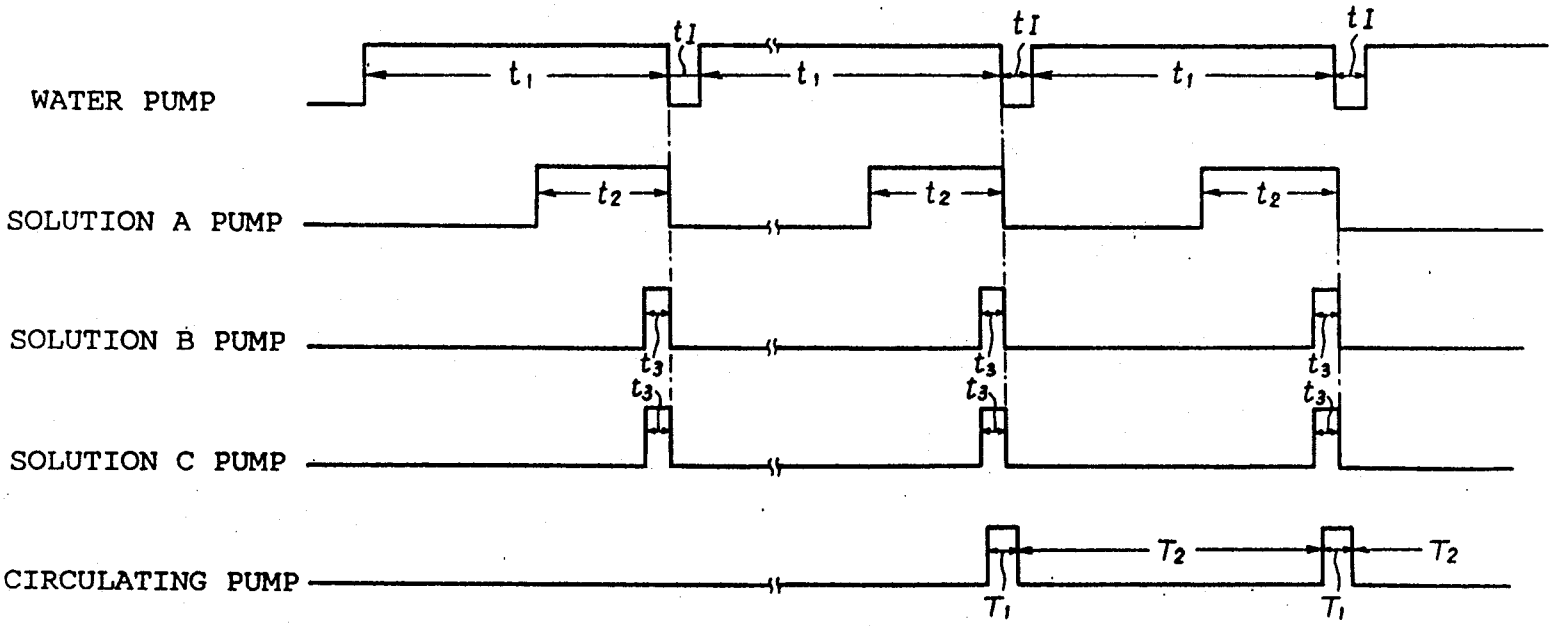
FIG. 14 a timing chart illustrating a state of discharge of solutions using a motor in accordance with this embodiment.

It should be noted that the ratio at which the solutions A, B, and C and water are mixed can be altered by operating an unillustrated keyboard. In this embodiment, since the solutions A, B, and C and water are supplied to the mixing tank by being intermittently discharged so that the liquid-discharging periods of the water pump, solution A pump, solution B pump, and solution C pump will partially overlap with each other, in Step 212, discharge time durations t1, t2, t3, and t4 ($t1>t2>t3=t4$) per discharge are set in correspondence with the mixing ratio of the solutions A, B, and C and water. If the mixing ratio is the one mentioned above, it follows that t1 : t2 : t3 (=t4) = 11 : 25 : 2. In addition, in Step 212, the number of times the liquid is discharged by the water pump or the like is determined by dividing the total amount of development replenisher to be supplied by the amount of development replenisher prepared per discharge, and an integral portion of this number of times of liquid discharge is set to n and a decimal portion thereof is set to m. In an ensuing Step 214, a determination is made as to whether or not the number of times of liquid discharge, P, by the water pump or the like is less than n. When $P<n$, a determination is made in Step 216 as to whether or not the number of times of liquid discharge, P, has reached a predetermined value nA. This predetermined value nA is used to prevent the circulating pump from being operated in the absence of the development replenisher in the circulating system, and the predetermined value nA is set to a value corresponding to, for instance, 5 l. When $P=nA$, the operation start timing of the circulating pump 72 is set in Step 218, and then the operation proceeds to Step 220. Meanwhile, when $P\neq nA$, the operation directly proceeds to Step 220. In Step 220, the water suppling pump 68A whose discharge time duration per discharge is the longest is operated to discharge water. In Step 222, a determination is made as to whether or not the time duration (t1 − t2) in which the second longest discharge time duration t2 is subtracted from the longest discharge time duration t1 has elapsed. When the time duration t1 − t2 has elapsed, in Step 224, the solution A pump is operated to discharge the solution A. In an ensuing Step 226, a determination is made as to whether or not the time duration (t1 − t3) in which the shortest discharge time duration t3 is subtracted from the longest discharge time duration t1 has elapsed. When the time duration t1 − t3 has elapsed, in Step 228, the solution B pump and the solution C pump are operated to discharge the solution B and the solution C. In Step 230, a determination is made as to whether or not the time duration t1 has elapsed, and when YES is the answer, in Step 232, the water pump 68A, solution A pump 64A, solution B pump 64B, and solution C pump 64C are simultaneously stopped to stop the discharge of the liquids. Then, in Step 234, the number of discharge times P is incremented by one, and a determination is made in Step 236 as to whether or not a time t1, which is a pump stopping time, has been reached. If the time t1 has been reached, the operation returns to Step 214, and Steps 214 through 236 are repeatedly executed. As a result, the water pump, solution A pump, solution B pump, and solution C pump are intermittently operated and are stopped simultaneously in such a manner that their operating periods partially overlap with each other, as shown in FIG. 14. Since the stock solution suppling pumps and the water pump are stopped simultaneously in the above-described manner, even if the stock solution adheres to the inner wall surface of the mixing tank, the stock solution is washed away by the water, so that deposition of the stock solution can be prevented.

If it is determined in Step 214 that $P\geqq n$, in order to supply the development replenisher for the decimal portion of the number of discharge times, in Step 238, the decimal portion m of the number of discharge times is converted to discharge time durations $t1_E$, $t2_E$, $t3_E$ ($=t4_E$) for the water pump, solution A pump, solution B pump, and solution C pump at the same ratio as the one mentioned above. Then, in Step 240, the water pump is operated as described above, and if it is determined in Step 242 that the time duration $t1_E$-$t2_E$ has elapsed, the solution A pump is operated in Step 244. Furthermore, if it is determined in Step 246 that the time duration $t1_E-t3_E$ has elapsed, the solution B pump and the solution C pump are operated in Step 248. If it is determined in Step 250 that the time duration $t1_E$ has elapsed, the solution A pump, solution B pump, and solution C pump are simultaneously stopped in Step 252. Then, in Step 254, a timing for stopping the circulating pump 72 is set, and the operation returns to the main routine. The timing for stopping the circulating pump 72 corresponds to a timing when the total volume of development replenisher has been supplied to the developing tank 14.

Figure 12:
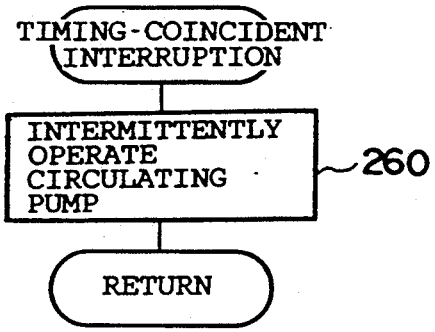
FIGS. 12 and 13 are flowcharts illustrating a time interruption routine.

FIG. 12 shows a timing-coincident interruption routine for effecting an interruption when the timing set in Step 218 has been reached. If this routine is started, the intermittent operation of the circulating pump 72 is commenced in Step 260. By operating the circulating pump in this manner, the replenisher in the mixing tank is smoothly supplied to the developing tank by virtue of the suction by the circulating pump. In addition, since the circulating pump is intermittently driven during replenishment with the replenisher, air is prevented from remaining in the pipe of the circulating system, thereby making it possible to prevent the air from bubbling up when the circulating pump is operated.

Figure 13:
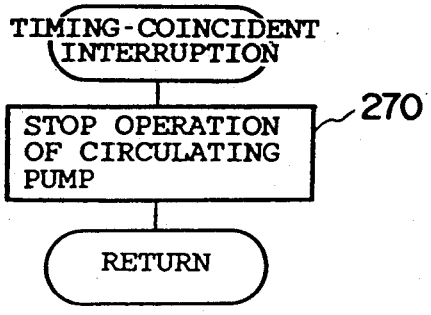

FIG. 13 shows a timing-coincident interruption routine for effecting an interruption when the timing set in Step 254 has been reached. If this interruption routine is started, the operation of the circulating pump is stopped in Step 270.

FIG. 14 illustrates a state of discharge of liquids by the water pump, solution A pump, solution B pump, solution C pump, and circulating pump when the above-described control is executed.

Meanwhile, when the amounts of undiluted replenishers in the respective tanks 50A, 50B, and 50C become small owing to the above-described replenishment, the balance between the atmospheric pressure and the weight of the undiluted replenishers in the tanks is lost, so that each of the undiluted replenishers in the cartridge 100 flows out to each tank. Hence, the solution levels of the undiluted replenishers in the tanks 50A, 50B, and 50C reach the fixed levels again. As this replenishment is repeatedly executed to supply the undiluted development replenishers A, B, and C in the cartridge 100 to the tanks 50A, 50B, and 50C, respectively.

Although in the foregoing example a description has been given of replenishment with the development replenisher, the present invention is not restricted to the same and can be applied to replenishment with a fixing replenisher as well. In addition, the photosensitive material processor to which the present invention is applicable may be any of an automatic processor for X-ray films, an automatic processor for photographic films, an automatic processor for presensitized printing plates, and so on.

A description will now be given of the replacement of the cartridges 100 and 120.

By rotating the retaining member 158 disposed above the solution supplying section 130, the retaining member 158 is disengaged from the unillustrated retaining projection, with the result that the solution supplying section 130 is set in a swingable state and is swung from the closed state to the open state by the unillustrated gas damper. This swinging motion is effected smoothly as the speed is controlled by the gas damper. When the solution supplying section 130 has been rotated by 15°, the swinging motion of the solution supplying section 130 is stopped by the gas damper, whereupon the loading and unloading of the cartridges 100 and 120 become possible. In this state, the used cartridges 100 and 120 are replaced with the new cartridges. Subsequently, it suffices if the outer panel 132 of the solution supplying section 130 is pressed to swing the solution supplying section 130 in a direction opposite to the aforementioned direction, and the retaining member 158 is engaged with the unillustrated retaining projection. Thus, the replacement of the cartridges can be effected promptly.

In addition, the change of the mounting position of the solution supplying section 130 is effected, for instance, as follows:

The cover 156 is first removed, the retaining member 158 is rotated to disengage the retaining member 158 from the unillustrated retaining projection, and the solution supplying section 130 is swung up to the open position. The cartridges 100 and 120 are pulled off the cartridge receiver 134. In this state, if the solution supplying section 130 is pulled upward, the engagement between the shaft members 152 with the leg portions 148 is canceled, and the gas damper is removed from the automatic processor 10.

On the other hand, the unillustrated cover on the side away from the side where the solution supplying section 130 was mounted is removed. On this opposite side, the solution supplying section 130 is mounted via the shaft members 152 and the gas damper, and the cartridges 100 and 120 are inserted into the cartridge receiver 134. Subsequently, the solution supplying section is closed, and the cover 156 is mounted below the solution supplying section 130. Then, the unillustrated cover which was mounted on this opposite side is attached to the side where the solution supplying section 130 was attached. In this manner the change of the mounting position of the solution supplying section 130 is performed.

In this embodiment, two portions are provided as the portion where the solution supplying section 130 can be mounted, but, such portions may be further added, if possible.

A description will now be given of a second embodiment.

In the description of this embodiment, those arrangements, members, parts, etc., that are similar to those of the first embodiment will be denoted by the same reference numerals, and a description thereof will be omitted.

Figure 15:
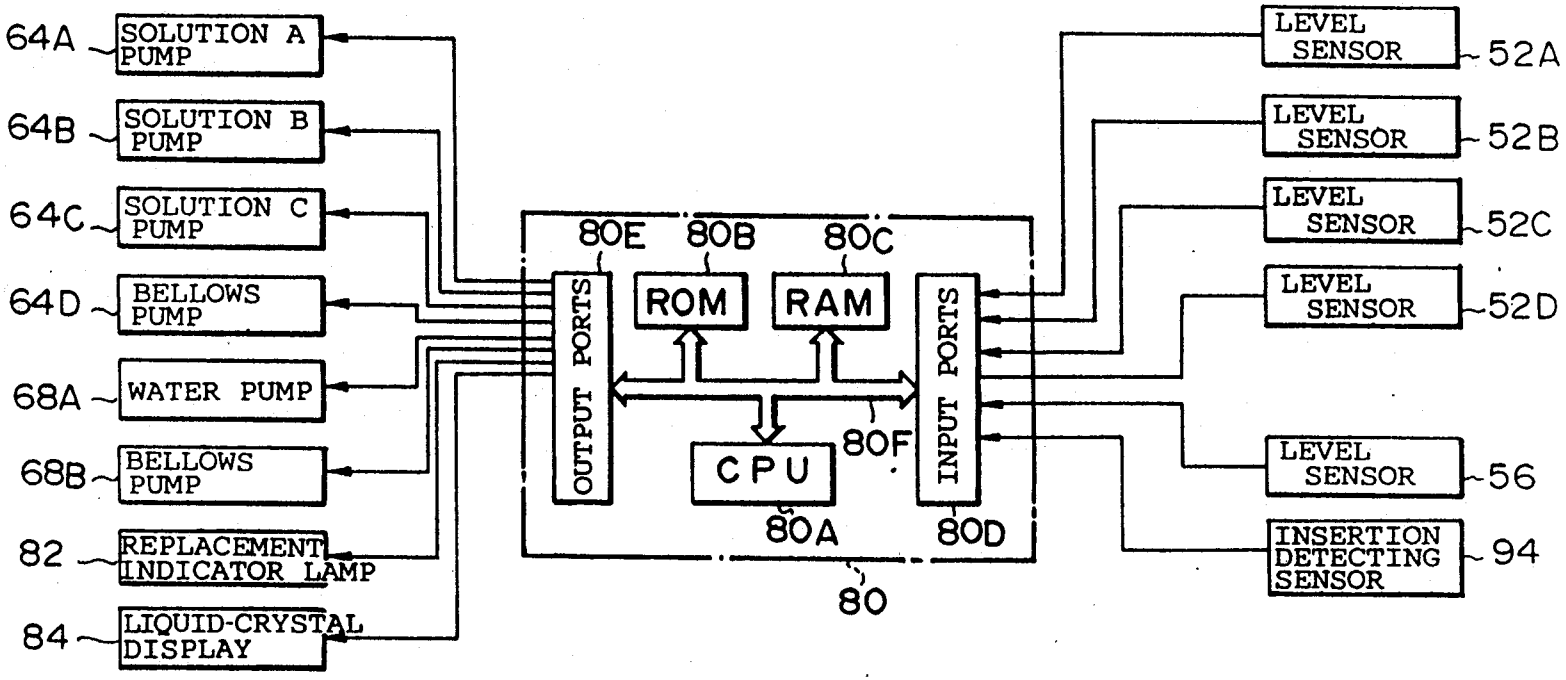
FIG. 15 is a block diagram schematically illustrating a replenishing device of an automatic processor in accordance with a second embodiment.

As shown in FIG. 15, in this embodiment, the circulating pumps 72 and 78 are subject to control by the controller 80 unlike in the case of the first embodiment. In addition, the contents of control by the controller 80 also differ from that of the first embodiment. The difference in the contents of control will become apparent from the description of the operation of this embodiment which will be given below. Since the other arrangements are similar to those of the first embodiment, a description thereof will be omitted.

A description will now be given of the operation of the second embodiment.

Figure 16:
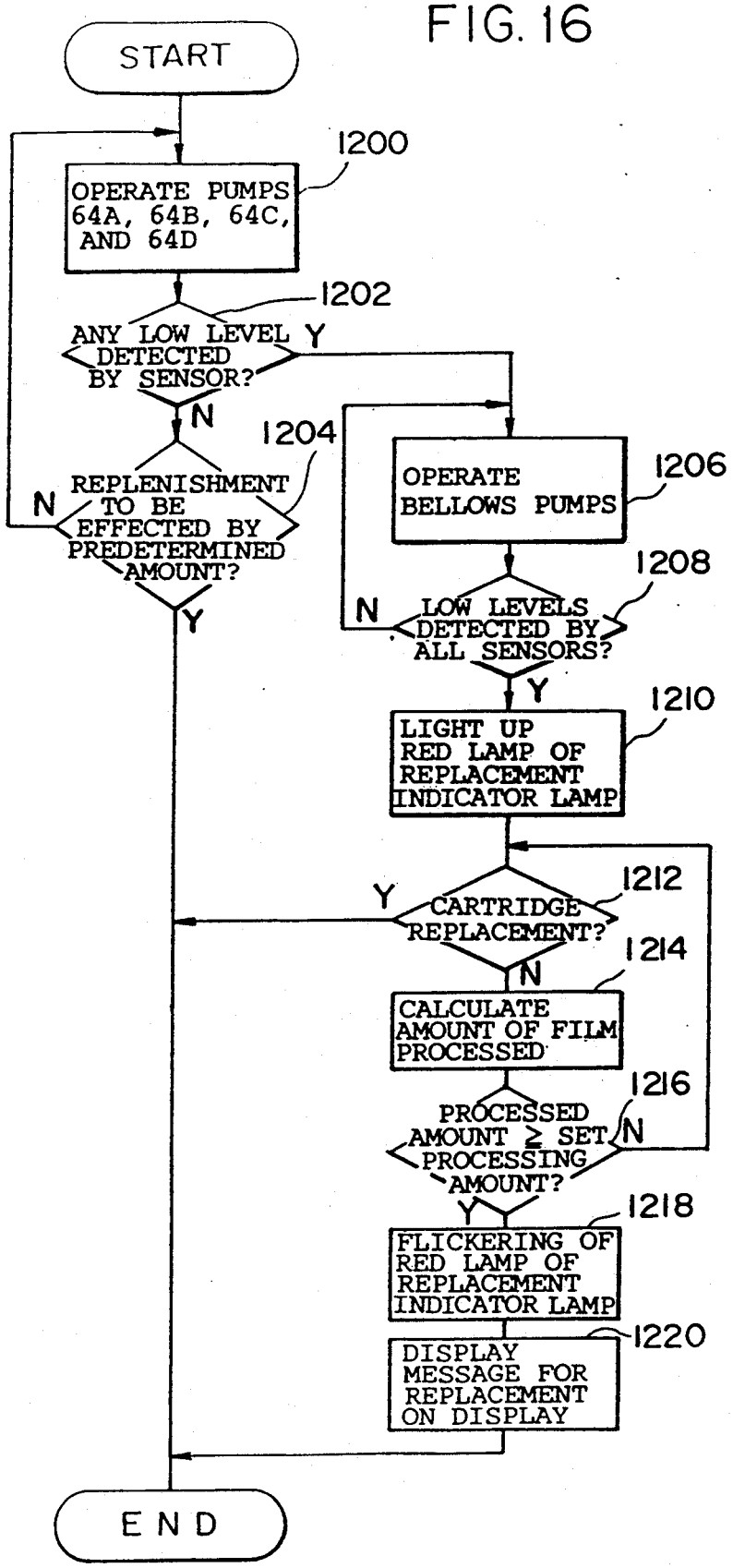
FIG. 16 is a flowchart illustrating the operation of the second embodiment.

The supply of the undiluted replenishers to the mixing tanks 58 and 60 (see FIG. 2) is effected by the replenishing device 25 of the photosensitive material processor. Referring now to a flowchart shown in FIG. 16, a description will be given of the supply of the undiluted replenishers by the replenishing device 25 of the photosensitive material processor (see FIG. 2). It should be noted that the replenishing device 25 monitors the amounts of the development replenisher in the mixing tank 58 and the fixing replenisher in the mixing tank 60, and when the amounts of the solutions are reduced, the flowchart is executed so as to supply predetermined amounts of undiluted replenishers set in advance.

When the cartridges 100 and 120 are inserted in the cartridge receiver for receiving the solution supplying section 130, and the filling ports 108, 110, 112, and 122 are set in the perforating portions 135, respectively, the undiluted replenishers are supplied to the respective tanks of the stock tank 50. The solution levels in the tanks are detected by the level sensors and the detected results are outputted to the controller 80. At this juncture, the controller 80 causes the replacement indicator lamp 82 to light the green lamp and causes the liquid-crystal display 84 to display the message reading "FILM PROCESSING POSSIBLE".

In Step 1200, the solution A pump 64A, solution B pump 64B, solution C pump 64C, and bellows pump 64D are operated. As a result, the solutions A, B, and C (hereinafter referred to the undiluted development replenisher(s) when all of these solutions A, B, and C are referred to and when any of them is referred to) are supplied from the tanks 50A, 50B, and 50C to the mixing tank 58, and the undiluted fixing replenisher is concurrently supplied from the tank 50D to the mixing tank 60. When the amounts of the solutions A, B, and C and the undiluted fixing replenisher (hereinafter referred to as the undiluted replenisher(s) when all of the solutions A, B, and C and the undiluted fixing replenisher are referred to and when any of them is referred to) become small, the balance between the atmospheric pressure and the weight of the undiluted replenishers in the tanks is lost, so that each of the undiluted replenishers in the cartridges 100 and 120 flows out to each tank. Hence, the solution levels of the undiluted replenishers in the tanks 50A, 50B, 50C, and 50D reach the fixed levels again. This replenishment is repeated executed, and the solutions A, B, and C in the cartridge 100 are supplied to the tanks 50A, 50B, and 50C, respectively, and the undiluted fixing replenisher in the cartridge 120 is supplied to the tank 50D.

In step 1202, a determination is made as to whether or not any of the solution levels is detected by the level sensors 52A, 52B, 52C, and 52D has reached a predetermined value or less. If all the solution levels exceed the predetermined values, a determination is made in Step 1204 as to whether or not the supply of predetermined amounts of the undiluted replenishers calculated in advance has been complete. If the supply of the predetermined amounts has not been completed. NO is given as the answer in the determination in Step 1204, and Steps 1200 through 1204 are repeated until the supply of the predetermined amounts is completed. Upon completion of the supply of the predetermined amounts of the undiluted replenishers, replenishing processing is ended.

As for the solution A pump 64A, solution B pump 64B, and solution C pump 64C, and bellows pump 64D that are operated during replenishment, the amounts of the undiluted replenishers supplied to the mixing tank 50 or the mixing tank 60 differ partly because the configurations of their bellows are not formed uniformly. For this reason, even though it is so initially designed that the undiluted development replenishers in the first chamber 102, second chamber 104, and third chamber 106 in the cartridge 100 and the undiluted fixing replenisher in the cartridge 120 are consumed simultaneously at a fixed ratio, there are cases where the amounts of the undiluted replenishers consumed differ from each other. For instance, even if all the amount of solution A has been consumed and the first chamber 102 has become empty, the solutions B and C and the undiluted fixing replenisher still remain in the cartridges 100 and 120. In this case, the solution level detected by the level sensor 52A reaches the predetermined value or less, so that YES is given as the answer in the determination in Step 1202, and the supply of the undiluted replenisher, which will be described hereinafter, is performed.

In Step 1206, the bellows pumps corresponding to undiluted replenishers other than the undiluted replenisher for which a drop in the solution level has been detected. For example, if a drop in the solution level of the solution A has been detected, the solution B pump 52B, solution C pump 52C, and bellows pump 52D corresponding to the solutions B and C and the undiluted fixing replenisher are operated. In Step 1208, a determination is made as to whether or not the solution levels detected by all the level sensors 52A, 52B, 52C, and 52D have reached the predetermined values or less. If any of the solution levels is higher than a predetermined value, Steps 1206 and 1208 are repeated until the solution levels detected by all the level sensors 52A, 52B, 52C, and 52D reach the predetermined values or less. It should be noted that the supply of the undiluted replenishers in this case should preferably be conducted in such a manner that the composition of the development replenisher in the mixing tank 58 and the composition of the fixing replenisher in the mixing tank 60 will not deviate from permissible ranges. If YES is given as the answer in the determination in Step 1208, the operation proceeds to Step 1210.

The state in which the solution levels detected by all the level sensors have reached the predetermined values or less is the state in which there are no undiluted replenishers in the cartridges 100 and 120. For this reason, in Step 1210, the replacement indicator lamp 82 is controlled so that the red lamp will be turned on, thereby instructing the user of the replenishing device 25 to replace the cartridges 100 and 120. As a result, the use is readily capable of ascertaining the period of replacement of the cartridges 100 and 120. At that time, since all the solutions A, B, and C in the cartridge 100 and the undiluted fixing replenisher in the cartridge 120 have been consumed, even if the user replaces the cartridges 100 and 120, the processor and its surroundings are not stained by the undiluted replenishers, so that maintenance is facilitated.

In Step 1212, a determination is made as to whether or not the user has replaced the cartridges 100 and 120. The determination of the cartridge replacement can be made by detecting whether or not, for instance, the retaining member 158 has been operated. If YES is given as the answer in the determination in Step 1212, processing is ended. If NO is given as the answer in the determination in Step 1212, the amount of film F processed (processed area) since the time when the replacement indicator lamp 82 has turned on the red lamp is calculated in Step 1214 on the basis of an output signal of the insertion detecting sensor 94. In Step 1216, a determination is made as to whether or not the amount of processing calculated in Step 1214 has reached an amount of processing set in advance or more. This amount of processing set in advance can be set to an amount corresponding to 200 films F of the 10×12 inch size, for instance. If NO is given as the answer in the determination in Step 1216, the operation returns to Step 1212, and Steps 1212 through 1216 are repeated until the cartridges are replaced or the amount of film F processed reaches the aforementioned amount of processing set in advance or more.

If YES is given as the answer in the determination in Step 1216, the replacement indicator lamp 82 causes the red lamp to flicker in Step 1218. In Step 1218, the liquid-crystal display 84 is made to display a message reading "REPLACE CARTRIDGES", thereby giving a warning to the user to replace the cartridges, and processing is ended.

Thus, in this embodiment, when at least one of the solution levels detected by the level sensors 52A, 52B, 52C, and 52D has reached a predetermined value or less, the undiluted replenishers are discharged form the cartridges 100 and 120 so that the other solution levels reach their predetermined values, and the replacement indicator lamp 82 is then turned on. Therefore, the user is capable of readily ascertaining the replacement period of the cartridges.

Although in this embodiment the indicating means for indicating the replacement of the cartridges 100 and 120 is constituted by the replacement indicator lamp 82, it suffices if the user is capable of ascertaining the replacement period of the cartridges 100 and 120, and a buzzer, for instance, may be operated for this purpose.

In addition, although the arrangement provided in this embodiment is such that the undiluted replenishers remaining in the stock tank 50 are supplied to the mixing tanks by means of the bellows pumps (solution A pump 64A, solution B pump 64B, solution C pump and bellows pump 64D), the invention is not particularly restricted to the same. For instance, an arrangement may be alternatively provided such that the undiluted replenishers in the tanks may be discharged to the outside by attaching discharge pipelines to the tanks 50A, 50B, 50C, and 50D of the stock tank 50, by providing valves midway in the discharge pipelines, and by operating these valves.

A description will now be given of a third embodiment.

In this embodiment, the structure of perforating portions 1135 differs from that of the perforating portions 135 of the first embodiment. That is, although all the height of the projections 142 in the first embodiment is the same, the height of all projections 1142 in this embodiment is not the same.

Figure 17:
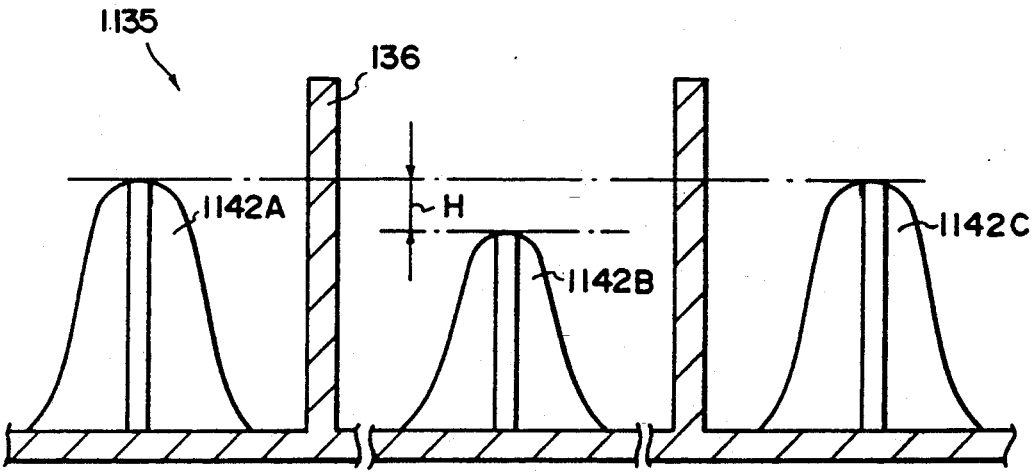
FIG. 17 is a side view illustrating a state in which a perforating section in accordance with a third embodiment is disposed.

Referring now to FIG. 17, a detailed description will be given of this aspect.

As the projections 1142 for the cartridge 100, three pieces are juxtaposed. A description will be given below by attaching the same reference characters (A, B, and C) to the ends of the reference numerals for the projections 1142 in correspondence with the undiluted development replenishers A, B, and C.

Among these three projections 1142A, 1142B, and 1142C, the height of the projection 1142B located in the center is lower by a height H than that of the projections 1142A and 1142C on both sides thereof. For this reason, when the cartridge 100 is loaded, the packing 114 corresponding to the solutions A and C first abuts against the projections 1142A and 1142C. Accordingly, a force with which the packing 114 is pushed in becomes virtually two-thirds as against the force with which the three pieces of packing 114 are pushed in simultaneously.

Meanwhile, the packing 114 corresponding to the solution B abuts against and is pushed in by the projection 1142B after the pushing in of the other two pieces of packing 114 has been virtually completed. Hence, the pushing-in force becomes practically one-third of the force with which all three pieces of packing 114 are simultaneously pushed in. Accordingly, the force with which all the pieces of packing 114 are pushed in becomes lighter than in a case where all three pieces are pushed in simultaneously.

In addition, when the cartridge 100 is initially loaded in the perforating portions 1135, the cartridge 100 abuts against the two portions (projections 1142A and 1142C), so that the cartridge 100 is prevented from being swung by being cantilevered, and the loading direction is prevented from changing (i.e., changing from a direction parallel with the axis of the projection 1142 to a direction perpendicular the axis).

Since the other arrangements are similar to those of the first embodiment, a description thereof will be omitted.

A description will be given of the operation of this embodiment through the replacement of the cartridge 100.

The solution supplying section 130 is swung from the closed state to the open state and is set in a state permitting the replacement of the cartridge 100. In this state, the used cartridge 100 is pulled out of the solution supplying section 130 (see FIG. 5), and a new cartridge 100 is inserted and loaded in the solution supplying section 130. At this juncture, with the cartridge 100 held upside down, the filling ports 108, 110, and 112 are first made to oppose the projections 1142A, 1142B, and 1142C, respectively. Then, if the cartridge 100 is lowered, the projections 1142A and 1142C abut against the packing 114. Since two positions are provided for initial abutment against the packing 114, the cartridge 100 is lowered stably without being swung or moving with play. Here, if the cartridge 100 is further pushed in, the pieces of packing 114 corresponding to the projections 1142A and 1142C are pushed in, respectively. This pressing force can be practically two-thirds of the force required for simultaneously pushing in all the three pieces of packing 114.

When the pieces of packing 114 of the first and third chambers 102 and 106 of the cartridge 100 filled with the solutions A and C are pushed in by the projections 1142A and 1142C, the packing 114 of the second chamber 104 filled with the solution B abuts against the projection 1142B and is pushed in thereby. The pushing-in force at this time can be virtually one-third of the force with which all three pieces of packing 114 are pushed in simultaneously.

Thus, in this embodiment, the force with which the packing 114 is pushed in can be made small, so that the packing 114 can be pushed in securely with a light force. In addition, the packing is prevented from becoming caught midway in the pushing-in operation, so that the operating efficiency can be improved.

Figure 18:
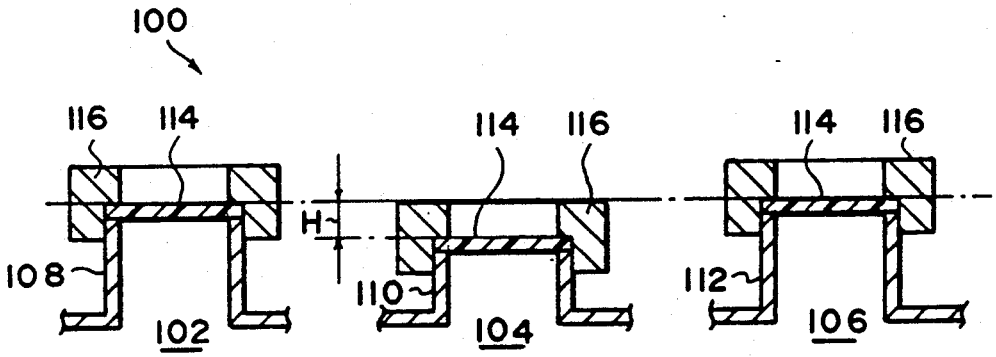
FIG. 18 is a side view of charging ports of a cartridge having different heights.

It should be noted that although in this embodiment the height of the projections 142 is varied to reduce the pushing-in force during the loading of the cartridge 100, a similar advantage to that of this embodiment can be obtained if, as shown in FIG. 18, the height of the filling ports 108, 110, and 112 of the cartridge 100 is varied by the dimension H. In addition, only the position where the packing 114 is disposed may be varied without changing the height of the filling ports 108, 110, and 112.

In the above-described embodiments, the cartridge is pushed into the cartridge receiver to perforate the cartridge while the cartridge receiver is opened with respect to the processor. However, one of the cartridge and the projections may be pushed toward the other to perforate the cartridge when the cartridge receiver is closed. In other words, the perforating section or the cartridge may be moved to perforate the cartridge in response to the closing operation of the cartridge receiver by making use of the movement of the cartridge receiver.

What is claimed is:

1. A photosensitive material processor having a processing tank for processing a photosensitive material, comprising:

a circulating system having a circulating pipeline and a circulating pump disposed in said circulating pipeline and adapted to circulate a liquid in said processing tank through said circulating pipeline by the operation of said circulating pump;

a mixing tank for preparing a processing solution by mixing a stock solution and a dilution liquid;

a stock solution supplying pump for supplying the stock solution to said mixing tank;

a dilution liquid supplying pump for supplying the dilution liquid to said mixing tank;

a supply pipeline for connecting said mixing tank and a portion of said circulating pipeline upstream of said circulating pump so that the processing solution prepared in said mixing tank is supplied to said processing tank; and control means for controlling said stock solution supplying pump and said dilution liquid supplying pump so that a ratio of periods of discharge of the liquids becomes a predetermined ratio, and for operating said circulating pump after the stock solution and the dilution liquid are supplied to said mixing tank by predetermined amounts.

2. A photosensitive material processor according to claim 1, wherein said control means controls said stock solution supplying pump and said dilution liquid supplying pump so that the periods of discharge of the liquids by said stock solution supplying pump and said dilution liquid supplying pump partially overlap with each other, and that timings at which the discharge of the liquids is stopped become simultaneous or substantially simultaneous.

3. A photosensitive material processor according to claim 1, wherein in a case where said processing tank is replenished with a replenishing solution, said control means controls said circulating pump in such a manner that said circulating pump operates intermittently.

4. A photosensitive material processor according to claim 2, wherein in a case where said processing tank is replenished with a replenishing solution, said control means controls said circulating pump in such a manner that said circulating pump operates intermittently.

5. A photosensitive material processor according to claim 1, further comprising:

a stock tank for accommodating the stock solution; and a cartridge receiver which is supported swingably between an open position in which the loading and unloading of a cartridge for the stock solution are possible and a closed position in which said cartridge is accommodated, said cartridge receiver being adapted to perforate said cartridge and to allow the stock solution in said cartridge to be supplied to said stock tank.

6. A photosensitive material processor according to claim 5, wherein said cartridge receiver has a perforating section for perforating said cartridge as said cartridge is pushed in.

7. A photosensitive material processor according to claim 5, wherein said cartridge receiver has a perforating section which perforates said cartridge in response to closing movement of said cartridge receiver.

8. A photosensitive material processor according to claim 5, wherein said cartridge receiver is detachable from said processor and has a plurality of supporting portions so that said cartridge receiver can be selectively supported by either one of said supporting portions.

9. A photosensitive material processor according to claim 5, wherein said cartridge has a plurality of partitioned chambers, to store mutually different stock solutions each of said plurality of partitioned chambers having a supply portion for supplying the stock solutions from said partitioned chambers, and said cartridge receiver is provided with perforating blades for perforating said supplying portions in a number corresponding to the number of said partitioned chambers.

10. A photosensitive material processor according to claim 9, wherein said perforating blades are so arranged that at least one perforating blade of said plurality of perforating blades lags behind any remaining perforating blades.

11. A photosensitive material processor according to claim 10, wherein the height of said at least one perforating blade is set to be lower than the height of said remaining perforating blades.

12. A photosensitive material processor according to claim 10, wherein at least one supplying portion of said plurality of supply portions is shorter than any remaining supplying portions.

13. A photosensitive material processor for processing a photosensitive material by consecutively transporting the photosensitive material to a plurality of processing tanks in which processing solutions are accommodated therein, respectively, comprising:

a solution supplying section in which a cartridge having a plurality of partitioned chambers with mutually different stock solutions accommodated therein is loaded;

a plurality of stock tanks for respectively storing the stock solutions supplied from said solution supplying section so as to replenish the processing solutions in said processing tanks;

level detecting means mounted on said plurality of stock tanks, respectively, and adapted to detect the solution levels of the stock solutions in said stock tanks; and control means for forcedly discharging remaining ones of the stock solutions when said level detecting means detects that at least one of the solution levels has reached a predetermine value or less.

14. A photosensitive material processor according to claim 13, further comprising indicating means which is actuated when said level detecting means detects that all the solution levels have reached predetermined values or less.

15. A photosensitive material processor according to claim 13, further comprising warning means for issuing a warning to replace said cartridge, after a predetermined amount of the photosensitive material has been processed since the actuation of said control means.

16. A photosensitive material processor according to claim 13, wherein said solution supplying section is swingable between an open position in which the loading and unloading of said cartridge are possible and a closed position in which said cartridge is accommodated.

17. A photosensitive material processor according to claim 16, wherein said solution supplying section has a perforating section for perforating said plurality of partitioned chambers of said cartridge and allowing the stock solutions stored in said chambers to be supplied to said plurality of stock tanks through the perforations.

18. A photosensitive material processor according to claim 16, wherein said solution supplying section is detachable with respect to said processor, and a plurality of portions where said solution supplying section can be mounted are provided.

19. A photosensitive material processor according to claim 16, wherein said perforating section is provided with a plurality of perforating blades for perforating said partitioned chambers, and said perforating section is so arranged that at least one of said perforating blades starts perforating said supplying portion by lagging behind remaining perforating blades.

20. A photosensitive material processor according to claim 19, wherein the height of said at least one perforating blade is set to be lower than the height of said remaining perforating blades.

21. A photosensitive material processor having a processing tank for processing a photosensitive material, comprising:

a mixing tank for preparing a processing solution by mixing a stock solution and a dilution liquid;

a stock solution supplying pump for supplying the stock solution to said mixing tank;

a dilution liquid supplying pump for supplying the dilution liquid to said mixing tank;

a pipe for connecting said mixing tank and said processing tank so that the processing solution prepared in said mixing tank is supplied to said processing tank; and control means for controlling said stock solution supplying pump and said dilution liquid supplying pump with a predetermined ratio of periods of discharge of the liquids such that the periods of discharge of the liquids partially overlap with each other, and such that timings at which the discharge of the liquids is stopped become simultaneous or substantially simultaneous.

22. A photosensitive material processor according to claim 21, further comprising:

a stock tank for accommodating the stock solution, the stock solution accommodated therein being supplied to said mixing tank by means of said stock solution supplying pump; and a cartridge receiver which is supported swingably between an open position in which the loading and unloading of a cartridge for the stock solution are possible and a closed position in which said cartridge is accommodated, said cartridge receiver being adapted to allow the stock solution in said cartridge to be supplied to said stock tank by perforating said cartridge as said cartridge is pushed in said cartridge receiver.

23. A photosensitive material processor according to claim 22, wherein said cartridge receiver is detachable with respect to said processor and has a plurality of supporting portions for supporting said cartridge receiver.

24. A photosensitive material processor according to claim 23, wherein said cartridge has a plurality of partitioned chambers to store mutually different stock solutions, each of said plurality of partitioned chambers having a supply portion for supplying the stock solutions from said partitioned chambers, and said cartridge receiver is provided with a plurality of perforating blades for perforating said supplying portions in a number corresponding to the number of said plurality of partitioned chambers.

25. A photosensitive material processor according to claim 24, wherein said cartridge receiver is so arranged that at least one perforating blade of said plurality of perforating blades lags behind any remaining perforating blades.

26. A photosensitive material processor according to claim 25, wherein the height of said at least one perforating blade is set to be lower than the height of said remaining perforating blades.

* * * * *

UNITED STATES PATENT AND TRADEMARK OFFICE

CERTIFICATE OF CORRECTION

PATENT NO. : 5,184,164

DATED : February 2, 1993

INVENTOR(S) : Junichi Kose et al

It is certified that error appears in the above-identified patent and that said Letters Patent is hereby corrected as shown below:

On the title page, item (75) inventors:

change "Ryoei Nozaki" to --Ryoei Nozawa--.

Signed and Sealed this

First Day of February, 1994

Bruce Lehman

*Attest:*

BRUCE LEHMAN

*Attesting Officer*

*Commissioner of Patents and Trademarks*